US009862197B2

(12) United States Patent
Takagiwa

(10) Patent No.: US 9,862,197 B2
(45) Date of Patent: Jan. 9, 2018

(54) CARTRIDGE CASE

(71) Applicant: BROTHER KOGYO KABUSHIKI KAISHA, Nagoya-shi, Aichi-ken (JP)

(72) Inventor: Yutaka Takagiwa, Kariya (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/270,511

(22) Filed: Sep. 20, 2016

(65) Prior Publication Data

US 2017/0087856 A1 Mar. 30, 2017

(30) Foreign Application Priority Data

Sep. 30, 2015 (JP) ..... 2015-194915

(51) Int. Cl.
*B41J 2/175* (2006.01)
*B65D 35/28* (2006.01)

(52) U.S. Cl.
CPC ..... *B41J 2/1752* (2013.01); *B41J 2/17503* (2013.01); *B41J 2/17513* (2013.01); *B41J 2/17566* (2013.01); *B65D 35/28* (2013.01); *B41J 2002/17586* (2013.01)

(58) Field of Classification Search
CPC ..... B41J 2002/17516; B65D 35/28; B65D 83/0055; B65D 83/0077
USPC ..... 222/101
See application file for complete search history.

(56) References Cited

U.S. PATENT DOCUMENTS 3,647,117 A * 3/1972 Hargest ..... A61M 5/148 222/100
3,670,926 A * 6/1972 Hill ..... A61M 5/148 222/101
3,874,934 A * 4/1975 Zangrando ..... H01M 6/38 429/79
2001/0043256 A1* 11/2001 Seccombe ..... B41J 2/17513 347/85

(Continued)

FOREIGN PATENT DOCUMENTS

JP 2010-105195 A 5/2010
JP 2012/161978 A 8/2012
WO 2015/101571 A1 7/2015

OTHER PUBLICATIONS

Extended European search report dated Dec. 12, 2016 issued in the corresponding European patent application No. 16189035.5.

*Primary Examiner* — Shelby Fidler
(74) *Attorney, Agent, or Firm* — K&L Gates LLP

(57) ABSTRACT

A cartridge case includes a case, a spout support portion, a mount portion, a roll-up member, and a lock member. The case includes a first face extending in a first direction. The spout support portion is configured to support a spout provided in a liquid container containing an inkjet liquid. An end portion on a first direction side of an elastic member is mountable in the mount portion. The elastic member generates an energizing force in the first direction. The roll-up member is configured to roll up the liquid container by being moved in the first direction by the energizing force of the elastic member. The lock member is configured to lock movement, in the first direction, of the roll-up member. The lock member is configured to release lock of the roll-up member, based on consumption of the inkjet liquid contained in the liquid container.

14 Claims, 17 Drawing Sheets

(56) References Cited

U.S. PATENT DOCUMENTS

| | | | | |
|---|---|---|---|---|
| 2009/0112149 | A1* | 4/2009 | Kriesel | A61M 5/14586 604/19 |
| 2010/0295908 | A1 | 11/2010 | Katoh et al. | |
| 2010/0309264 | A1 | 12/2010 | Midorikawa | |
| 2011/0306941 | A1* | 12/2011 | Chandrasekar | A61M 3/0254 604/262 |
| 2013/0038667 | A1 | 2/2013 | Bachar et al. | |
| 2014/0043411 | A1 | 2/2014 | Kobayashi et al. | |
| 2014/0332558 | A1* | 11/2014 | Takagiwa | B41J 2/17523 222/107 |
| 2015/0273841 | A1* | 10/2015 | Takagiwa | B41J 2/17513 347/86 |
| 2015/0273843 | A1* | 10/2015 | Takagiwa | B41J 2/17513 347/86 |
| 2015/0273844 | A1* | 10/2015 | Takagiwa | B41J 2/17513 347/86 |

* cited by examiner 3
64
32
60
62
61
644
240
220
225
241
215
210
228
223
218
222
205
212
224
436
432A
431D
432D
213
432
431A
230
433
430
214
431
434
227
81
435
43
81F
81C
80
231
81B
474
217
81E
472
47
81A
85
48
46
90A
45
475
90
81G
471
478
82
484
481
479E
473
90B
473A
355
83A
473B
310
83
84
461
399
334
352
522A
482
351
399
524
485
335A
451
451
489
335
33
488
34
483
521
523
551
541
450
522
400
52
344
364
347
542
389
355
552
51
345
37
(SECOND DIRECTION)
UP
345
REAR
RIGHT
84B
512
362
333A
511
333
513
346
LEFT
FRONT (FIRST DIRECTION)
360
398
388
361
300
DOWN

CARTRIDGE CASE

CROSS-REFERENCE TO RELATED APPLICATION

This application claims priority to Japanese Patent Application No. 2015-194915 filed Sep. 30, 2015. The contents of the foregoing applications are hereby incorporated herein by reference.

BACKGROUND

The present disclosure relates to a cartridge case that can accommodate a liquid container that contains a liquid.

A cartridge case is known that can accommodate a liquid container that contains a liquid. For example, an ink tank is known that supplies ink to a record head of an inkjet recording apparatus. The ink tank is an example of a cartridge case. The ink tank includes an ink bag, a case, and a roll-up member. The ink bag contains a liquid ink. The case accommodates the ink bag and can be mounted in and removed from the inkjet recording apparatus. The roll-up member is disposed inside the case and can roll up the ink bag. The inkjet recording apparatus includes a spring as the roll-up force generation member. When the ink tank is inserted into the inkjet recording apparatus, the roll-up member engages with the spring. The energizing force of the spring causes the roll-up member to roll up the ink bag and apply pressure to the ink.

SUMMARY

When the ink bag is an ink bag in which the edges of two synthetic resin sheets are welded together and a spout is provided in the front end of the ink bag, if the ink inside the ink bag has not yet been consumed, the central portion of the ink bag bulges outward. At that time, the straight line distance between the front end and the rear end of the ink bag is shorter than when the ink is consumed. Therefore, the edges of the ink bag may be compressed and buckle inward near the rear end of the ink bag, so that dimples may form in the edges near the rear end of the ink bag. If the roll-up member rolls up the ink bag from the rear end in a state in which the dimples have formed, the dimples may become even larger. In that case, there is a possibility that a rolling-up abnormality may occur, such as the roll-up member rolling up the ink bag without flattening the ink bag. If a rolling-up abnormality occurs, there is a possibility that an appropriate amount of the ink may not flow to the print head, causing the printing quality to deteriorate.

Embodiments of the broad principles derived herein provide a cartridge case that can reduce a possibility that an abnormality may occur in rolling-up of a ink bag.

Embodiments provide a cartridge case that includes a case, a spout support portion, a mount portion, a roll-up member, and a lock member. The case includes a first face extending in a first direction. The spout support portion is provided on an end portion side of the case. The end portion side is a side on which an end portion of the case is provided in the first direction. The spout support portion is configured to support a spout provided on a liquid container containing an inkjet liquid. An end portion on a first direction side of an elastic member is mountable in the mount portion. The mount portion is provided on the end portion side of the case. The elastic member extends in a second direction. The second direction is an opposite direction from the first direction. The elastic member generates an energizing force in the first direction. The roll-up member extends in an orthogonal direction. The orthogonal direction is a direction parallel to the first face and orthogonal to the first direction. The roll-up member is configured to roll up the liquid container by being moved in the first direction by the energizing force of the elastic member. The lock member is configured to lock movement, in the first direction, of the roll-up member positioned at an end of the case in the second direction. The lock member is configured to release lock of the roll-up member positioned at the end of the case in the second direction, based on consumption of the inkjet liquid contained in the liquid container.

BRIEF DESCRIPTION OF THE DRAWINGS

Embodiments will be described below in detail with reference to the accompanying drawings in which.

DETAILED DESCRIPTION

Figure 1:
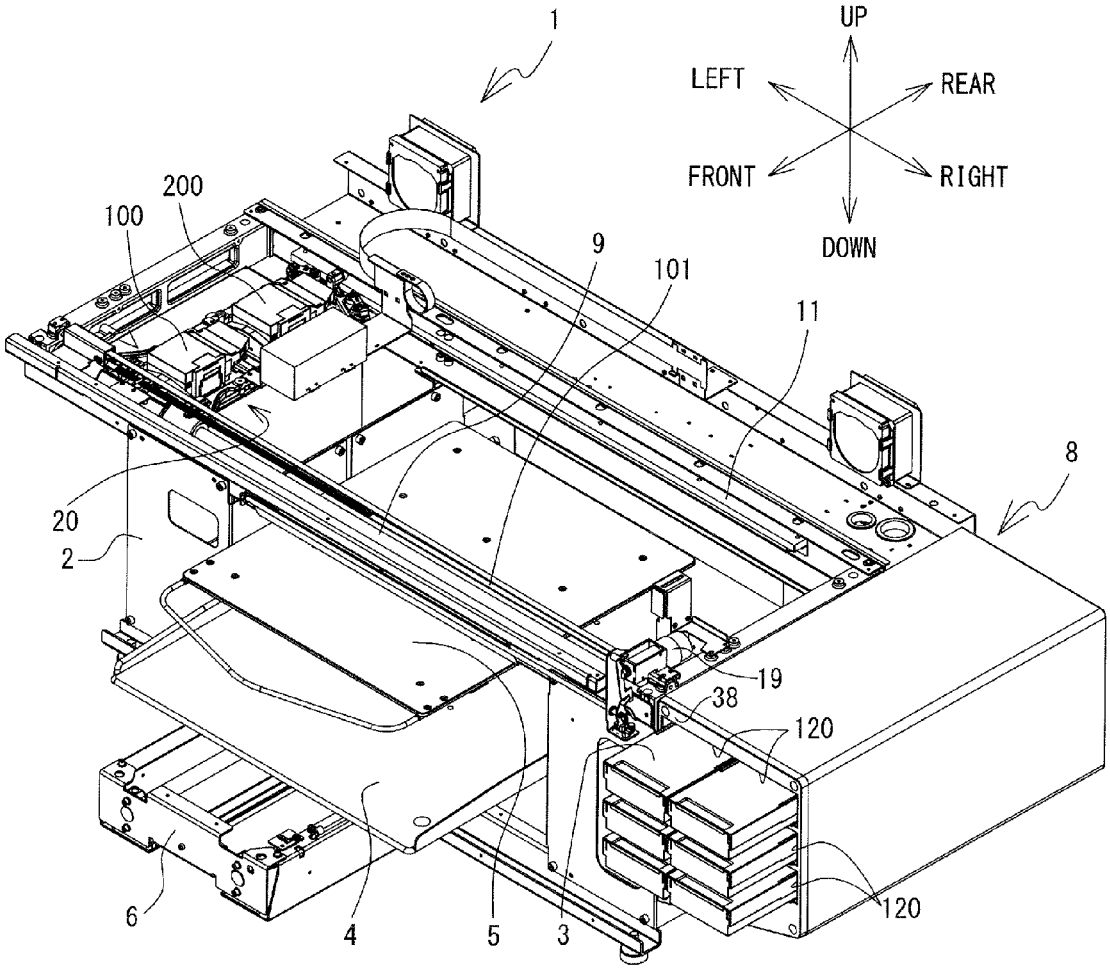
FIG. 1 is an oblique view of a printer.

A printer 1 of a first embodiment will be explained with reference to the drawings. In the explanation that follows, the terms left, right, front, rear, up, and down that are used are those indicated by the arrows in the drawings. The overall structure of the printer 1 will be explained with reference to FIG. 1.

The printer 1 is an inkjet printer that performs printing by ejecting an ink onto a cloth (not shown in the drawings) such as a T-shirt. The ink is an example of a liquid. The cloth is a print medium. The print medium may be a paper or the like. The printer 1 can print a color image on the print medium by ejecting five different types of the ink (white, black, yellow, cyan, and magenta) downward.

The printer 1 includes a housing 2, a platen drive mechanism 6, a platen 5, a tray 4, a shaft 9, a rail 11, a carriage 20, head units 100, 200, a drive belt 101, and a drive motor 19. The housing 2 is substantially a three-dimensional rectangle. An operation portion (not shown in the drawings) is provided on the front side of the right portion of the housing 2. The operation portion is used to perform an operation of the printer 1. The operation portion includes a display and an operation button. The display displays various types of information.

The platen drive mechanism 6 is provided with a motor (not shown in the drawings) at the rear edge of the housing 2. The driving force of the motor moves the platen 5 and the tray 4 in the front-rear direction of the housing 2 along a pair of rails (not shown in the drawings). The platen 5 is a plate that is rectangular in a plan view. The top face of the platen 5 serves as a placement surface for the print medium. The tray 4 is rectangular in a plan view and is disposed below the platen 5.

The top portion of the housing 2 has a frame body that is rectangular in a plan view. The frame body of the housing 2 supports the shaft 9 and the rail 11 on its inner side. The carriage 20 can be conveyed in the left-right direction along the shaft 9 in a higher position than the platen 5. The head units 100 and 200 are mounted on the carriage 20. A head portion (not shown in the drawings) is provided on the bottom face of each of the head units 100 and 200. Each of the head portions includes a plurality of nozzles. The operation of piezoelectric elements causes the head portions to eject droplets of the ink downward from the nozzles.

The drive belt 101 has a belt shape that spans the inner side of the frame body of the housing 2 in the left-right direction. The drive motor 19 is configured to rotate forward and in reverse. The drive motor 19 is coupled to the carriage 20 through the drive belt 101. The printer 1 performs printing on the print medium by causing the platen 5 to convey the print medium in the front-rear direction (a conveyance direction, a sub-scanning direction) and causing the head portions to eject the ink as the head portions are moved reciprocally in the left-right direction by the drive motor 19.

A cartridge mount portion 8 is provided on the right side of the printer 1. The inks supplied to the respective head portions of the head units 100 and 200 flow from cartridge cases 3 mounted in the cartridge mount portion 8. A plurality of cartridge cases 3, such as six cartridge cases 3, are mounted in the cartridge mount portion 8. A frame portion 38 is provided in the front portion of the cartridge mount portion 8. Openings 120 are provided in the frame portion 38 and are arrayed in three rows in the up-down direction and two columns in the left-right direction. Each one of the openings 120 has a shape that allows one of the cartridge cases 3 to be inserted into and removed from the each one of the openings 120. A spout 7 (refer to FIG. 2) of a liquid container 31 inside the cartridge case 3 includes a rubber plug (not shown in the drawings). The cartridge mount portion 8 is provided with hollow needles (not shown in the drawings) that correspond to the individual openings 120. When the cartridge case 3 is mounted in the cartridge mount portion 8, the hollow needle (not shown in the drawings) pierces the rubber plug, such that the hollow needle draws the ink out of the liquid container 31.

[Cartridge Case 3]

Figure 3:
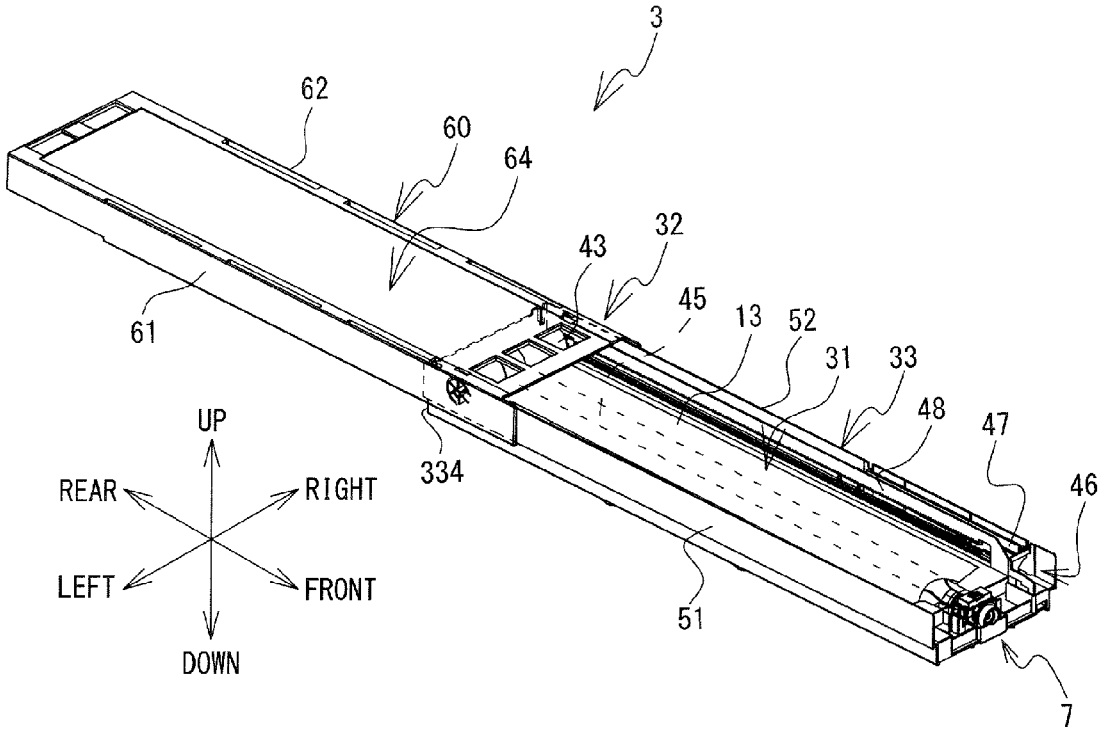
FIG. 3 is an oblique view of the cartridge case in which the second case is in an open position, as seen from above.

The direction from the rear side of the cartridge case 3 toward the front side is called the first direction. The opposite direction from the first direction is called the second direction. As shown in FIG. 3, the cartridge case 3 includes the liquid container 31 and a case 32. The case 32 accommodates the liquid container 31 in its interior.

Figure 4:
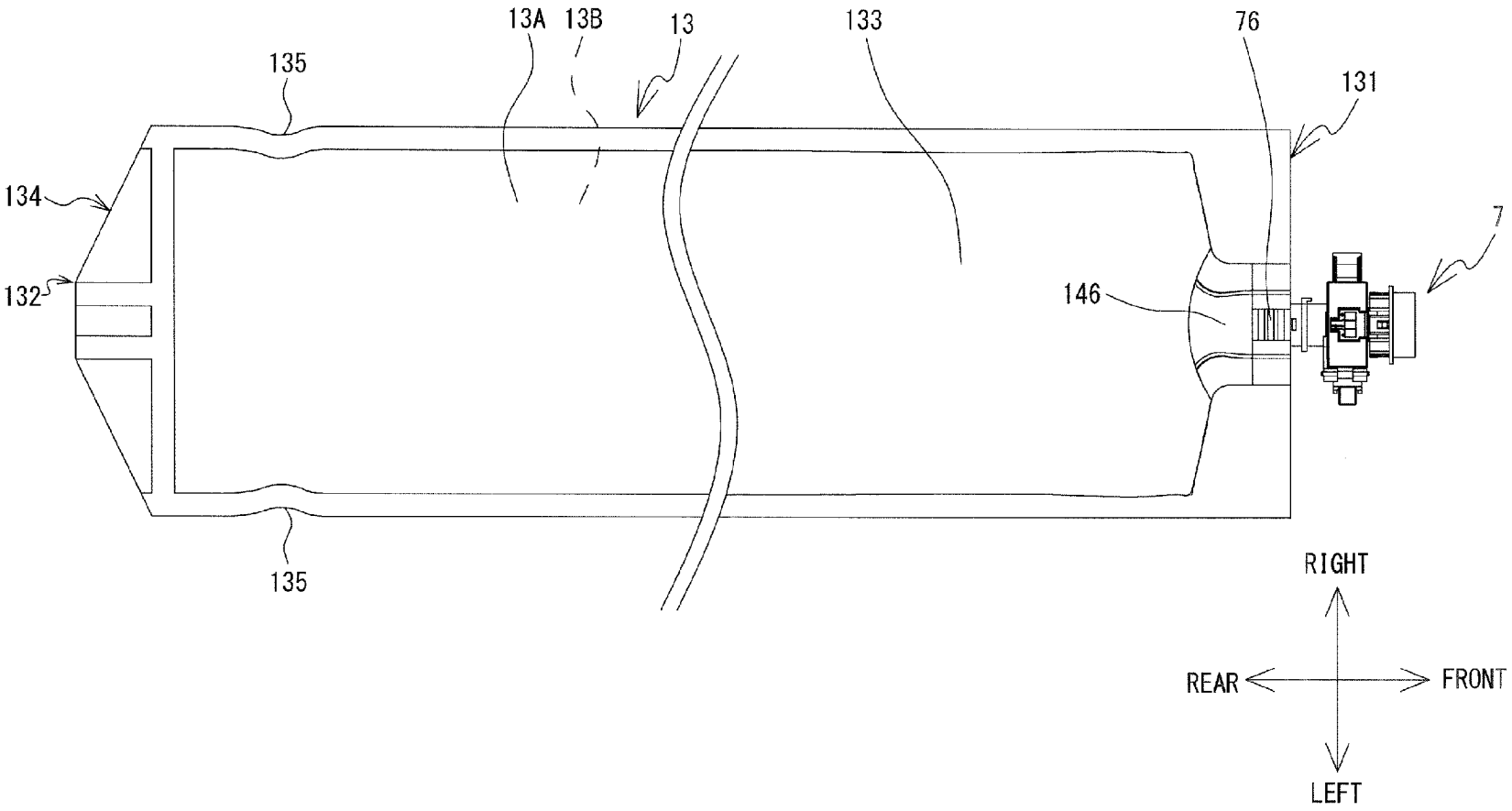
FIG. 4 is a plan view of a liquid container.

As shown in FIG. 4, the liquid container 31 includes a liquid bag 13 and the spout 7. The liquid bag 13 is a bag-shaped container formed by connecting peripheral edges of two sheets 13A and 13B in a state in which the sheets 13A and 13B are overlapped each other such that one face of the sheet 13A is opposed to one face of the sheet 13B. In the liquid bag 13, the peripheral edges of the two sheets 13A, 13B, which may be flexible, rectangular resin sheets, for example, are connected by one of heat welding and heat sealing. The liquid bag 13 extends in the front-rear direction. In the explanation that follows, the front edge of the liquid bag 13 is called the first edge 131. The rear edge of the liquid bag 13 is called the second edge 132.

The liquid bag 13 includes a liquid-holding portion 133 and an extension portion 134. A liquid is contained in the interior of the liquid portion 133. The liquid may be an ink, a discharge agent that decolorizes a dyed cloth, or the like. In the present embodiment, the liquid is an ink. The extension portion 134 is a portion of the liquid bag 13 that does not contain any ink. The extension portion 134 is provided at the second edge 132 of the liquid bag 13 and extends toward the rear from the liquid-holding portion 133. An insertion portion 76 of the spout 7 is inserted between the sheets 13A and 13B in the first edge 131. A curved region 146 is provided in the first edge 131. The curved region 146 is formed by curving the sheets 13A and 13B around the insertion portion 76 in the direction (the up-down direction) in which the sheets 13A and 13B are separated from each other. The curved region 146 extends to the rear of the insertion portion 76.

The spout 7 has a circular cylindrical shape that extends in the front-rear direction. The spout 7 is connected to the first edge 131 of the liquid bag 13. The rubber plug is disposed in the interior of the spout 7 and seals the spout 7 such that the ink inside the liquid-holding portion 133 does not leak out. The insertion portion 76 is provided in the rear end of the spout 7. The insertion portion 76 has a circular cylindrical shape that extends in the front-rear direction. The sheets 13A and 13B are thermally welded to the insertion portion 76.

[Case 32]

Figure 2:
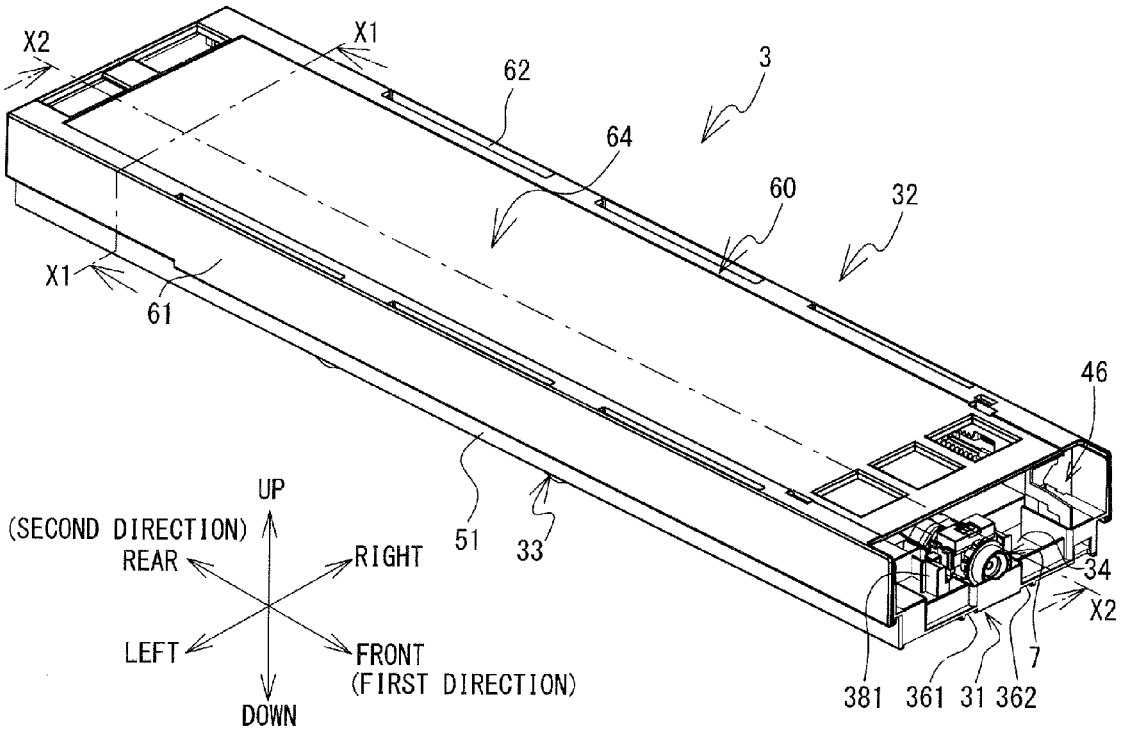
FIG. 2 is an oblique view of a cartridge case in which a second case is in a closed position, as seen from above.

As shown in FIGS. 2 and 3, the case 32 has a box shape with its long axis extending in the front-rear direction. The case 32 includes a first case 33, a second case 60, a roll-up member 43, an elastic member 45, a detection portion 46 (refer to FIG. 5), a switching member 205 (refer to FIG. 5), and the like. The first case 33 supports the liquid container 31. The second case 60 is disposed on the top side of the first case 33. The second case 60 can slide in the front-rear direction in relation to the first case 33. The position in which the second case 60 has been slid toward the front and the top of the first case 33 is closed, as shown in FIG. 2, is called the closed position. The position in which the second case 60 has been slid toward the rear and the top of the first case 33 is open, as shown in FIG. 3, is called the open position.

[First Case 33]

Figure 5:
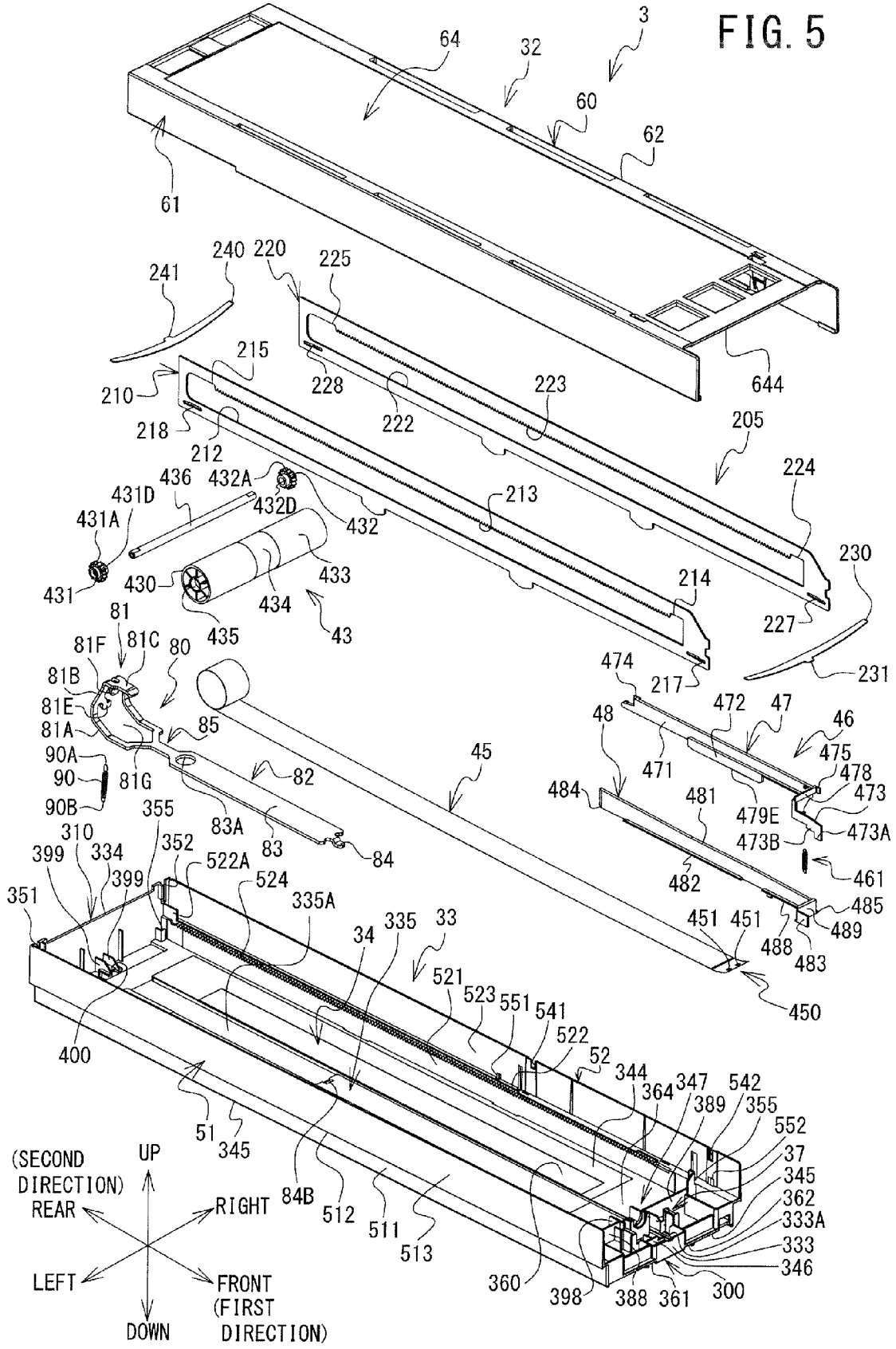
FIG. 5 is an exploded oblique view of a case.

As shown in FIG. 5, the first case 33 includes a support wall portion 34, a spout support portion 37, a pair of side walls 51, 52, a front wall portion 333, a rear wall portion 334, and the like. The support wall portion 34 is a wall portion that extends in the front-rear direction and the left-right direction. The support wall portion 34 is rectangular with its long axis extending in the front-rear direction. The top face of the support wall portion 34 is called the first inner face 344. The first inner face 344 extends in the front-rear direction and the left-right direction. The first direction and the second direction are aligned to the front-rear direction, in which the first inner face 344 is longer than in the left-right direction. The first inner face 344 is the top face of the support wall portion 34 and extends in the first direction from the rear toward the front. The first inner face 344 extends in the front-rear direction and the left-right direction and is longer in the front-rear direction than in the left-right direction. The first direction is the forward direction, toward the spout support portion 37. The second direction is the rearward direction, away from the spout support portion 37. The bottom face of the support wall portion 34 is called the first outer face 345. The pair of the side walls 51 and 52 respectively extend upward from the left side and the right side of the support wall portion 34. The side wall 51 is a side wall on the left side of the first case 33. The side wall 52 is a side wall on the right side of the first case 33. The rear wall portion 334 extends upward on a rear edge portion 310 of the support wall portion 34. The rear wall portion 334 is a side wall on the rear side of the first case 33.

Figure 7:
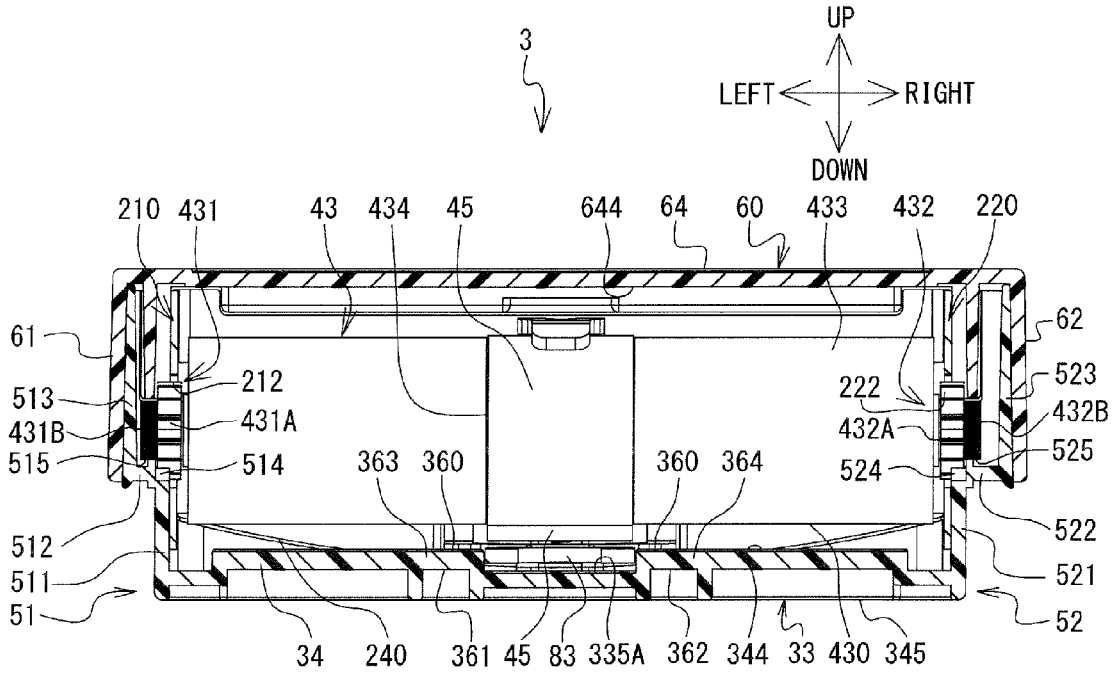
FIG. 7 is a section view, as seen from the direction of arrows along a line X1-X1 in FIG. 2.

As shown in FIGS. 5 and 7, the side wall 51 on the left side includes a first section 511, a second section 512, a third section 513, and a lower support portion 514. The first section 511 is a wall portion that extends upward from the left edge of the first inner face 344. The first section 511 constitutes a lower side part of the side wall 51. The second section 512 is a section that projects to the left from the top edge of the first section 511. The third section 513 is a wall portion that extends upward from the left edge of the second section 512. The third section 513 constitutes an upper side part of the side wall 51.

The side wall 52 on the right side includes a first section 521, a second section 522, a third section 523, and a lower support portion 524. The first section 521 is a wall portion that extends upward from the right edge of the first inner face 344. The first section 521 constitutes a lower side part of the side wall 52. The second section 522 is a section that projects to the right from the top edge of the first section 521. The third section 523 is a wall portion that extends upward from the right edge of the second section 522. The third section 523 constitutes an upper side part of the side wall 52. A restriction wall (not shown in the drawings) on the rear end of the second section 522 projects upward from the second section 522.

The second section 512 is provided with the lower support portion 514 on its right edge. The second section 522 is provided with the lower support portion 524 on its left edge. The lower support portions 514 and 524 are provided symmetrically on the left and right sides, respectively. Each of the lower support portions 514 and 524 is a rack gear on which a plurality of teeth facing upward are arrayed continuously in the front-rear direction. The lower support portion 514 is positioned on the right edge of the second section 512. The lower support portion 524 is positioned on the left edge of the second section 522 (refer to FIG. 5). The lower support portions 514 and 524 extend from slightly in front of the rear wall portion 334 to slightly to the rear of the spout support portion 37.

Figure 6:
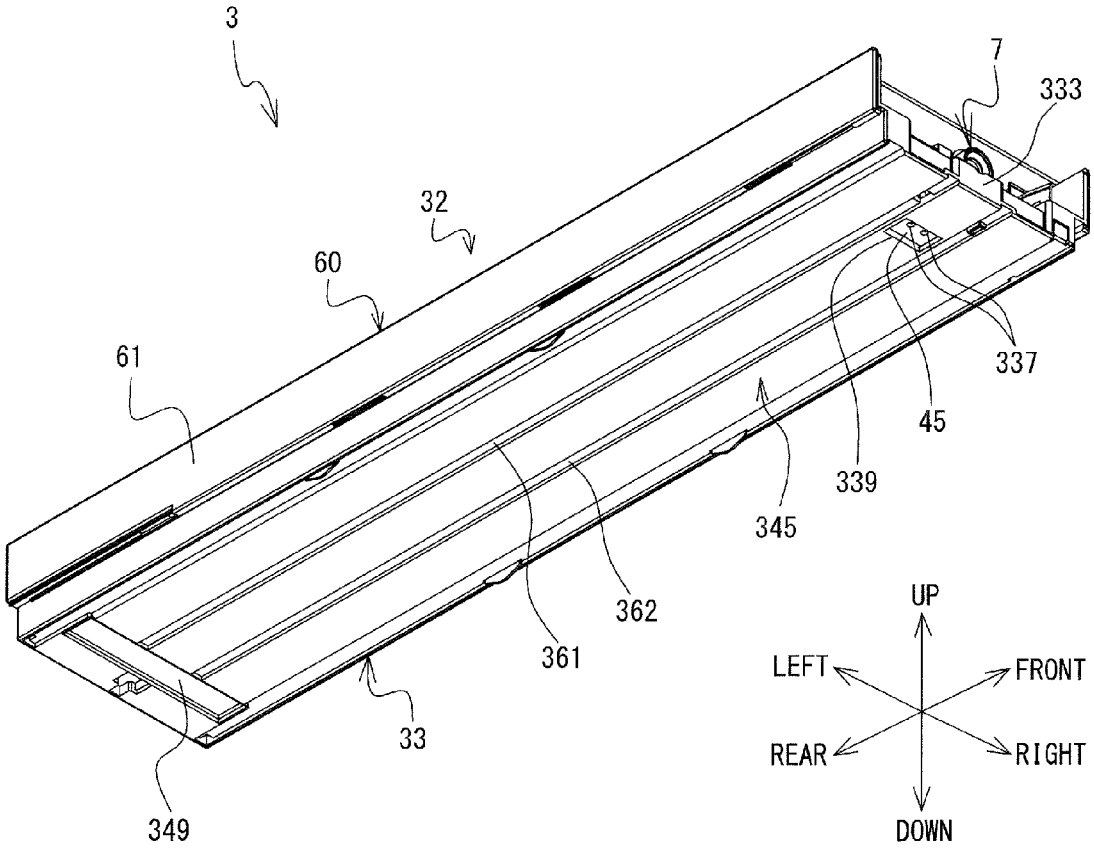
FIG. 6 is an oblique view of the cartridge case in which the second case is in the closed position, as seen from below.

As shown in FIG. 5, the front wall portion 333 is rectangular in a front view. The front wall portion 333 is provided on a front end portion 300 of the support wall portion 34. The front wall portion 333 extends upward from the center in the left-right direction of the front end of the first inner face 344 to substantially the same height as the upper edges of the first sections 511 and 521. A recessed portion 333A is formed in the center in the left-right direction of the front wall portion 333. The recessed portion 333A is a portion that is recessed downward in a circular arc shape from the upper edge of the front wall portion 333. As shown in FIG. 6, two grooves 361 and 362 are recessed upward in the first outer face 345. The groove 361 is provided in the left side of the front wall portion 333. The groove 362 is provided in the right side of the front wall portion 333. The grooves 361 and 362 extend from the front end portion 300 of the support wall portion 34 to slightly in front of the rear edge portion 310. Projecting portions 363 and 364 are located in the first inner face 344 on the upper sides of the grooves 361 and 362, respectively (refer to FIG. 7). The projecting portions 363 and 364 each extend in the front-rear direction while projecting upward. Anti-slip members 360 are plate-shaped pieces of rubber. The anti-slip members 360 are affixed to the top faces of the projecting portions 363 and 364.

As shown in FIG. 5, the spout support portion 37 is provided on the front end of the support wall portion 34. The spout support portion 37 supports the spout 7. The spout support portion 37 includes a first support portion 346 and a second support portion 347. The first support portion 346 is provided to the rear of the front wall portion 333. The first support portion 346 is a plate-shaped member that is T-shaped in a plan view. The first support portion 346 projects upward from the first inner face 344. The second support portion 347 is provided to the rear of the first support portion 346, between the two grooves 361 and 362. The second support portion 347 is a wall portion that extends in the left-right direction. The second support portion 347 extends upward from the support wall portion 34. A recessed portion 348 is a portion that is recessed downward from the upper edge of the second support portion 347 in a substantially semicircular shape. In a front view, the recessed portion 348 is positioned slightly higher than the recessed portion 333A. A case recessed portion 335 is disposed on the first inner face 344. The case recessed portion 335 is a portion that is recessed downward between the projecting portions 363 and 364. The case recessed portion 335 extends from the rear side of the spout support portion 37 to the front side of the rear edge of the support wall portion 34. A groove portion 335A is a portion to the rear of the center in the front-rear direction of the case recessed portion 335. The depth of the groove portion 335A is deeper than the rest of the case recessed portion 335. The groove portion 335A accommodates a detection plate member 83 and the elastic member 45, both of which will be described below. The detection plate member 83 is disposed under the elastic member 45. As shown in FIG. 6, a mount opening 339 is provided in the case recessed portion 335 on the rear side of the spout support portion 37 (refer to FIG. 5). The mount opening 339 is an opening that extends through the support wall portion 34 in the up-down direction. A mount plate (not shown in the drawings) is provided slightly above the mount opening 339. The mount plate is provided with two lugs 337. The two lugs 337 are arrayed in the left-right direction and project downward from the mount plate. In a bottom view, the two lugs 337 are exposed through the mount opening 339.

As shown in FIG. 5, anchor walls 388 and 389 are respectively provided on the left and right sides of the second support portion 347. The anchor wall 388 extends upward from the first inner face 344 and extends in the left-right direction between the second support portion 347 and the first section 511. The anchor wall 389 extends upward from the first inner face 344 and extends in the left-right direction between the second support portion 347 and the first section 521. Holding portions 398 are provided on the anchor walls 388 and 389. The holding portions 398 are a pair of plate-shaped bodies that extend toward the rear from the right end of the anchor wall 388 and the left end of the anchor wall 389. An energizing member 230, which will be described below, is affixed to the holding portions 398. Holding portions 399 are provided on the rear wall portion 334. The holding portions 399 are a pair of plate-shaped bodies that project toward the front from a central portion in the left-right direction of the rear wall portion 334. An energizing member 240, which will be described below, is affixed to the holding portions 399. An anchoring portion 400 is disposed below and between the pair of the holding portions 399. The anchoring portion 400 anchors the lower portion of a coil spring 90, which will be described below.

A slit 355 is provided in the upper part of the right edge of the anchor wall 389. Another slit 355 is provided on the left side of the rear end of the first section 521. These slits 355 support the front and rear edges of a presser plate 220 such that the presser plate 220 can move up and down. A slit is provided in the upper part of the left edge of the anchor wall 388, although not shown in the drawings. Another slit is provided on the right side of the rear end of the first section 511. These slits support the front and rear edges of a presser plate 210 such that the presser plate 210 can move up and down.

[Switching Member 205]

As shown in FIG. 5, the switching member 205 includes the presser plates 210, 220 and the energizing members 230, 240. The presser plate 210 is a frame-shaped plate that extends in the up-down direction and the front-rear direction. The length of the presser plate 210 in the up-down direction is slightly less than the length of the side wall 51 in the up-down direction. The length of the presser plate 210 in the front-rear direction is substantially equal to the length from the rear wall portion 334 to the anchor wall 388 in the front-rear direction. The presser plate 210 includes a slide opening 212, an upper support portion 213, a retraction portion 214, and a retraction portion 215.

In a side view, the slide opening 212 is provided on the inner side of the presser plate 210 and is a substantially rectangular opening whose long axis extends in the front-rear direction. The slide opening 212 extends through the presser plate 210 in the left-right direction. The slide opening 212 extends from the rear end to the front end of the presser plate 210. The upper edge and the lower edge of the slide opening 212 are substantially parallel and are opposed to each other in the up-down direction. The upper support portion 213 is a portion provided over the entire upper edge of the slide opening 212, except for the front and rear end portions of the slide opening 212.

The upper support portion 213 is a rack gear on which a plurality of teeth facing downward are arrayed continuously in the front-rear direction. The length from the lower edge of the slide opening 212 to the upper support portion 213 in the up-down direction is slightly greater than a diameter of a rotary gear 431A of a shaft support portion 431. The retraction portions 214 and 215 are the front and rear end portions of the slide opening 212. The upper edge of the slide opening 212 in the retraction portions 214 and 215 is higher than the upper support portion 213. The up-down length and the front-rear length of the slide opening 212 in the retraction portions 214 and 215 are both slightly greater than the diameter D1 of the rotary gear 431A. The rotary gear 431A of the shaft support portion 431 passes through the inner side of the slide opening 212. The rotary gear 431A rotates while meshing with the rack gear of the lower support portion 514. The shaft support portion 431 can therefore move in the front-rear direction within the slide opening 212.

The presser plate 220 is identical to the presser plate 210. The presser plate 220 includes a slide opening 222, an upper support portion 223, a retraction portion 224, and a retraction portion 225. A rotary gear 432A of a shaft support portion 432 passes through the inner side of the slide opening 222. The rotary gear 432A rotates while meshing with the rack gear of the lower support portion 524. The shaft support portion 432 can therefore move in the front-rear direction within the slide opening 222.

The presser plates 210 and 220 are attached to the first case 33 by the energizing members 230 and 240. The energizing members 230 and 240 are identical flat springs that extend in the left-right direction. The energizing members 230 and 240 are respectively attached to the holding portions 398 and 399. An anchoring nub 231 is provided in the center of the energizing member 230 and projects toward the front. An anchoring nub 241 is provided in the center of the energizing member 240 and projects toward the rear.

As shown in FIGS. 5 and 7, the presser plate 210 is disposed along the right face of the first section 511, between the rear wall portion 334 and the anchor wall 388. The presser plate 220 is disposed along the left face of the first section 521, between the rear wall portion 334 and the anchor wall 389. Therefore, the presser plates 210 and 220 are respectively arranged side by side with the first sections 511 and 521 in the left-right direction.

The holding portion 398 is anchored by the anchoring nub 231, thus preventing the energizing member 230 from shifting in the left-right direction. The energizing member 230 is prevented from shifting in the front-rear direction because the energizing member 230 is positioned by an anchor member (not shown in the drawings). Anchor holes 217 and 227 are respectively provided in the presser plates 210 and 220. The left and right ends of the energizing member 230 are respectively inserted into the anchor holes 217 and 227. The holding portion 398 holds the anchoring nub 231 in a position lower than the anchor holes 217 and 227. Therefore, the energizing member 230 is oriented such that, in a front view, both ends of the energizing member 230 curve upward from the central portion. In this orientation, the elastic force of the curved energizing member 230 energizes the presser plates 210 and 220 downward. The holding portion 399 is anchored by the anchoring nub 241, thus preventing the energizing member 240 from shifting in the left-right direction. The energizing member 240 is prevented from shifting in the front-rear direction because the energizing member 240 is positioned by an anchor member (not shown in the drawings). Anchor holes 218 and 228 are respectively provided in the presser plates 210 and 220. The left and right ends of the energizing member 240 are respectively inserted into the anchor holes 218 and 228. The holding portion 399 holds the anchoring nub 241 in a position lower than the anchor holes 218 and 228. Therefore, the energizing member 240 is oriented such that, in a front view, both ends of the energizing member 240 curve upward from the central portion. In this orientation, the elastic force of the curved energizing member 240 energizes the presser plates 210 and 220 downward.

[Roll-Up Member 43]

As shown in FIGS. 5 and 7, the roll-up member 43 includes a shaft body 430, shaft support portions 431, 432, and a coupling shaft 436. The shaft body 430 has a circular cylindrical shape that extends in the left-right direction. The shaft body 430 includes an outer circumferential face 433, a shaft recessed portion 434, and a shaft hole 435. The outer circumferential face 433 may have an anti-slip function. For example, the outer circumferential face 433 may be covered with an anti-slip resin sheet, an anti-slip surface treatment may be performed on the outer circumferential face 433, and the shaft body 430 itself may be an elastic member such as rubber. It is acceptable for the outer circumferential face 433 not to have an anti-slip function.

The shaft recessed portion 434 is provided in the center in the left-right direction of the outer circumferential face 433. The shaft recessed portion 434 has a groove shape that is recessed slightly toward the inside of the shaft body 430 from the outer circumferential face 433. The shaft hole 435 is a hole that passes in the left-right direction through the cross-sectional center (the rotational center) of the shaft body 430. The coupling shaft 436 is inserted into the shaft hole 435 such that the coupling shaft 436 can rotate, and both ends of the coupling shaft 436 protrude from the shaft hole 435 on the left and right sides. The shaft body 430 can rotate around the coupling shaft 436 inserted into the shaft hole 435. For example, the coupling shaft 436 is simply inserted into the shaft body 430 without being affixed to the shaft body 430, so that the shaft body 430 rotates in relation to the coupling shaft 436.

The shaft support portions 431 and 432 are respectively affixed to the left and right ends of the shaft body 430. As shown in FIGS. 5 and 7, the shaft support portions 431 and 432 are substantially coaxial with the center of rotation of the shaft body 430. The shaft support portion 431 includes the rotary gear 431A and a shaft portion 431B. The rotary gear 431A is a disc-shaped gear around the circumference of which a plurality of teeth are formed. The rotary gear 431A may be a gear used together with a rack, for example. The rotary gear 431A meshes with the lower support portion 514 and with the upper support portion 213 of the presser plate 210. A coupling hole 431D is provided in the rotational center of the rotary gear 431A. The coupling shaft 436 is affixed to the shaft support portion 431 by inserting the left end of the coupling shaft 436 into the coupling hole 431D. The shaft portion 431B is a circular cylinder whose diameter is smaller than that of the rotary gear 431A. The left end of the shaft portion 431B projects to the left from the rotary gear 431A.

In the same manner, the shaft support portion 432 includes the rotary gear 432A and a shaft portion 432B. The rotary gear 432A is a disc-shaped gear around the circumference of which a plurality of teeth are formed. The rotary gear 432A may be a gear used together with a rack, for example. The rotary gear 432A meshes with the lower support portion 524 and with the upper support portion 223 of the presser plate 220. A coupling hole 432D is provided in the rotational center of the rotary gear 432A. The coupling shaft 436 is affixed to the shaft support portion 432 by inserting the right end of the coupling shaft 436 into the coupling hole 432D. The shaft portion 432B is a circular cylinder whose diameter is smaller than that of the rotary gear 432A. The right end of the shaft portion 432B projects to the right from the rotary gear 432A.

As shown in FIG. 7, the shaft body 430 is disposed inside the first case 33, between the presser plates 210 and 220. The lower support portion 514 is exposed on the right side through the slide opening 212. The shaft support portion 431 projects leftward from the left end of the shaft body 430 toward the side wall 51 and is inserted into the slide opening 212 from the right side. The rotary gear 431A is disposed inside the slide opening 212 and meshes with the lower support portion 514. A rib 515 is provided on the top face of the second section 512 and extends in the front-rear direction. The shaft portion 431B is disposed on the top side of the rib 515.

In the same manner, the lower support portion 524 is exposed on the left side through the slide opening 222. The shaft support portion 432 projects rightward from the right end of the shaft body 430 toward the side wall 52 and is inserted into the slide opening 222 from the left side. The rotary gear 432A is disposed inside the slide opening 222 and meshes with the lower support portion 524. A rib 525 is provided on the top face of the second section 522 and extends in the front-rear direction. The shaft portion 432B is disposed on the top side of the rib 525. The roll-up member 43 is supported from below by the ribs 515 and 525 in a state in which the outer circumferential face 433 is slightly higher than the first inner face 344. The rotary gears 431A and 432A respectively mesh with the lower support portions 514 and 524 in a state in which there are small backlashes. Therefore, the rotary gears 431A and 432A can rotate smoothly in conjunction with the movement of the roll-up member 43.

As shown in FIGS. 3 and 5, the elastic member 45 is a flat spring with one of a fixed load and a variable load. The elastic member 45 is disposed on the inner side of the case recessed portion 335. Two round holes 451 are arrayed in the left-right direction in a front end portion 450 of the elastic member 45. When the elastic member 45 is placed into the case recessed portion 335, the front end portion 450 of the elastic member 45 is inserted from the rear into the gap between the mount plate (not shown in the drawings) and the mount opening 339 (refer to FIG. 6). The front end portion 450 of the elastic member 45 is anchored to the mount opening 339 by engaging the two lugs 337 in the two round holes 451 (refer to FIG. 6). The elastic member 45 extends toward the rear from the mount plate and is wound around the shaft recessed portion 434 of the roll-up member 43. Because the elastic member 45 generates a restorative force toward the front, the elastic member 45 energizes the roll-up member 43 toward the front through the shaft body 430. The energizing force of the elastic member 45 toward the front causes the roll-up member 43 to move toward the front, so that the roll-up member 43 rolls up the liquid container 31.

[Second Case 60]

As shown in FIGS. 5 and 7, the second case 60 includes an upper wall portion 64 and a pair of side walls 61 and 62. The upper wall portion 64 is a wall portion that extends in the front-rear direction and the left-right direction. The upper wall portion 64 is rectangular with its long axis extending in the front-rear direction.

[Detection Portion 46]

As shown in FIG. 5, the detection portion 46 includes a first side plate 47, a second side plate 48, and a coil spring 461. The first side plate 47 and the second side plate 48 are disposed on the front end side of the case 33, on the right side, which is one of two sides in an orthogonal direction. The first side plate 47 and the second side plate 48 extend in the front-rear direction. The orthogonal direction is a direction (the left-right direction) parallel to the first inner face 344 and orthogonal to the front-rear direction. The first side plate 47 is disposed above the second side plate 48. The first side plate 47 is provided with a first indicator portion 473 on its front end. The second side plate 48 is provided with a second indicator portion 483 on its front end. The coil spring 461 engages with the first side plate 47 and the second side plate 48. The coil spring 461 energizes the first side plate 47 and the second side plate 48.

A wall portion 478 is connected to the front end of the first arm portion 471 and extends to the left. The plate-shaped first indicator portion 473 extends toward the front from the lower part of the left edge of the wall portion 478. The first indicator portion 473 is disposed to the left from the first arm portion 471. The first indicator portion 473 includes a first projecting portion 473A and a second projecting portion 473B. The first projecting portion 473A projects downward from the front tip of the first indicator portion 473. The second projecting portion 473B projects downward on the rear side of the first projecting portion 473A. The bottom edge of the second projecting portion 473B is positioned higher than the bottom edge of the first projecting portion 473A.

The first side plate engaging portions 474 and 475 engage with first support openings 541 and 542, respectively. The first side plate engaging portion 475 is separated forward from the first side plate engaging portion 474. The first support openings 541 and 542 are slits formed in the side wall 52 of the first case 33. The first side plate engaging portion 474 is provided on the upper portion of the rear end of the first arm portion 471. The first side plate engaging portion 474 projects toward the right from the first arm portion 471, and the right edge of the first side plate engaging portion 474 extends toward the rear. The first side plate engaging portion 475 is provided on the upper portion of the front end of the first arm portion 471. The first side plate engaging portion 475 projects toward the right from the first arm portion 471, and the right edge of the first side plate engaging portion 475 extends toward the front.

The first spring mount portion (not shown in the drawings) is provided on the rear of the first side plate engaging portion 475. The first spring mount portion projects toward the left from the top edge of the first arm portion 471, and the left edge of the first spring mount portion extends upward. The upper end of the coil spring 461 is mounted on the first spring mount portion.

The second side plate 48 includes the second arm portion 481, a second contact portion 482, a second indicator portion 483, second side plate engaging portions 484, 485, a second spring mount portion (not shown in the drawings), and a projecting portion 488. The second indicator portion 483 is provided on the front end of the second side plate 48. The plate-shaped second arm portion 481 extends toward the front. The second arm portion 481 is provided to the rear of the second indicator portion 483. The second arm portion 481 is longer in the front-rear direction than the first arm portion 471 of the first side plate 47.

The second contact portion 482 projects toward the left from a portion of the second arm portion 481. The outer circumferential face of the shaft portion 431B of the shaft support portion 431 (refer to FIG. 7) can contact the top face of the second contact portion 482. The second contact portion 482 projects to the left from the bottom edge of the second arm portion 481. The second contact portion 482 extends toward the front from a point that is slightly toward the front from the rear end of the second arm portion 481. The front end of the second contact portion 482 is provided slightly toward the front from the center in the front-rear direction of the second arm portion 481. The projecting portion 488 is provided on the bottom edge of the second arm portion 481, toward the front from the second contact portion 482. The projecting portion 488 is separated forward from the second contact portion 482.

A wall portion 489 is connected to the front end of the second arm portion 481 and extends to the left. The plate-shaped second indicator portion 483 extends toward the front from the left edge of the wall portion 489. The second indicator portion 483 is provided to the left from the second arm portion 481. The second indicator portion 483 is rectangular in a left side view.

The second side plate engaging portions 484 and 485 engage with second support openings 551 and 552, respectively. The second side plate engaging portion 485 is separated forward from the second side plate engaging portion 484. The second support openings 551 and 552 are openings that are formed in the side wall 52 of the first case 33. The second side plate engaging portion 484 is provided on the lower edge of the rear end of the second arm portion 481 and projects toward the right from the second arm portion 481. The second side plate engaging portion 485 is provided on the lower edge of the front end of the second arm portion 481 and projects toward the right from the second arm portion 481.

The second spring mount portion (not shown in the drawings) is provided to the rear of the second side plate engaging portion 485. The second spring mount portion projects toward the left from the bottom edge of the second arm portion 481, and the left edge of the second spring mount portion extends downward. The lower end of the coil spring 461 is mounted on the second spring mount portion. As shown in FIG. 5, the coil spring 461 extends in the up-down direction. The upper end of the coil spring 461 is a circular ring that can be mounted on the first spring mount portion. The lower end of the coil spring 461 is a circular ring that can be mounted on the second spring mount portion.

[Structure of First Case 33 that Supports the First Side Plate 47 and the Second Side Plate 48]

As shown in FIG. 5, the distance between the first support openings 541 and 542 corresponds to the distance between the first side plate engaging portions 474 and 475 of the first side plate 47. The first support openings 541 and 542 are slits that extend in the up-down direction. The first support openings 541 and 542 support the first side plate 47 such that the first indicator portion 473 (refer to FIGS. 10A and 10B) can move in the up-down direction.

The first side plate engaging portions 474 and 475 are disposed in the first support openings 541 and 542. The second side plate engaging portions 484 and 485 are disposed in the second support openings 551 and 552. In this arrangement, the coil spring 461 is mounted on the first spring mount portion (not shown in the drawings) and the second spring mount portion (not shown in the drawings) in a state in which the coil spring 461 is stretched in the up-down direction. The restorative force of the coil spring 461 energizes the first spring mount portion downward and energizes the second spring mount portion upward.

The top face of the lower support portion 524 is a rack. The top face of the lower support portion 524 is a rolling surface on which the shaft support portion 432 of the roll-up member 43 rolls. The rack extends toward the front. A first contact portion 472 and the second contact portion 482 are disposed obliquely in relation to the rack. For example, the first contact portion 472 may be disposed such that the first contact portion 472 becomes lower as the first contact portion 472 extends in the first direction. For example, the second contact portion 482 may be disposed such that the second contact portion 482 becomes higher as the second contact portion 482 extends in the first direction. In a state in which the first side plate 47 and the second side plate 48 are each disposed on the side wall 52, a bottom face 479 of the first contact portion 472 is positioned above the top face of the second contact portion 482 such that the bottom face 479 is opposed to the top face of the second contact portion 482. When the shaft support portion 432 moves toward the front, the bottom face 479 of the first contact portion 472 and the top face of the second contact portion 482 contact the outer circumferential face of the shaft portion 432B (refer to FIG. 7).

The printer 1 can display the amount of the remaining ink by detecting the positions of the first indicator portion 473 and the second indicator portion 483, which move in the up-down direction in accordance with the amount of the remaining ink. The first indicator portion 473 moves between a lower position and an upper position. The second indicator portion 483 moves between a lower position and an upper position. The combination of the positions of the first indicator portion 473 and the second indicator portion 483 is changed in four states. The printer 1 includes a first optical detection portion (not shown in the drawings) and a second optical detection portion (not shown in the drawings). The first optical detection portion includes a first light emitting portion (not shown in the drawings) and a first light receiving portion (not shown in the drawings). The second optical detection portion includes a second light emitting portion (not shown in the drawings) and a second light receiving portion (not shown in the drawings). When the cartridge mount portion 8 is mounted in the cartridge case 3, for example, the second projecting portion 473B of the first indicator portion 473 is positioned to the right of the first light emitting portion, the second projecting portion 473B is positioned to the left of the first light receiving portion, the second indicator portion 483 is positioned to the right of the second light emitting portion, and the second indicator portion 483 is positioned to the left of the second light receiving portion.

When the first light receiving portion detects the light emitted by the first light emitting portion, the first optical detection portion outputs a value 1. When the second light receiving portion detects the light emitted by the second light emitting portion, the second optical detection portion outputs a value 1. When one of the first indicator portion 473 and the second indicator portion 483 blocks the light emitted by the first light emitting portion, the first light receiving portion does not detect the light, and thus the first optical detection portion outputs a value 0. When one of the first indicator portion 473 and the second indicator portion 483 blocks the light emitted by the second light emitting portion, the second light receiving portion does not detect the light, and thus the second optical detection portion outputs a value 0. A CPU (not shown in the drawings) of the printer 1 detects the amount of the remaining ink by detecting the combination of the output values 1 and 0 from the first optical detection portion and the second optical detection portion.

[Lock Member 80]

The structure of a lock member 80 will be explained with reference to FIGS. 5 and 8 to 10. The lock member 80 rotates between a locked position (refer to FIG. 12A) and a released position (refer to FIGS. 12B and 12C), which will be described below. The lock member 80 prevents the roll-up member 43 from being moved toward the front by the energizing force of the elastic member 45 toward the front, and allows the roll-up member 43 to be moved toward the front. The lock member 80 includes a hook portion 81, a detection portion 82, and a connecting portion 85. The connecting portion 85 connects the hook portion 81 and the detection portion 82. The lock member 80 may be made of a synthetic resin or a metal, for example.

Figure 8:
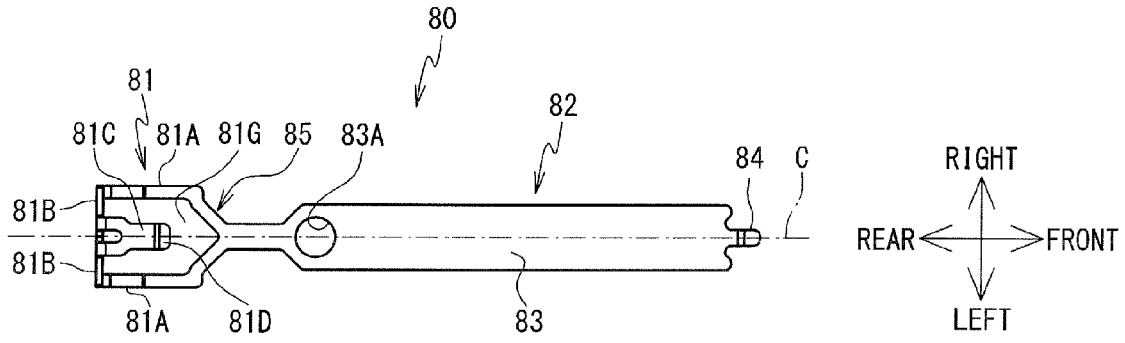
FIG. 8 is a plan view of a lock member.
Figure 9:
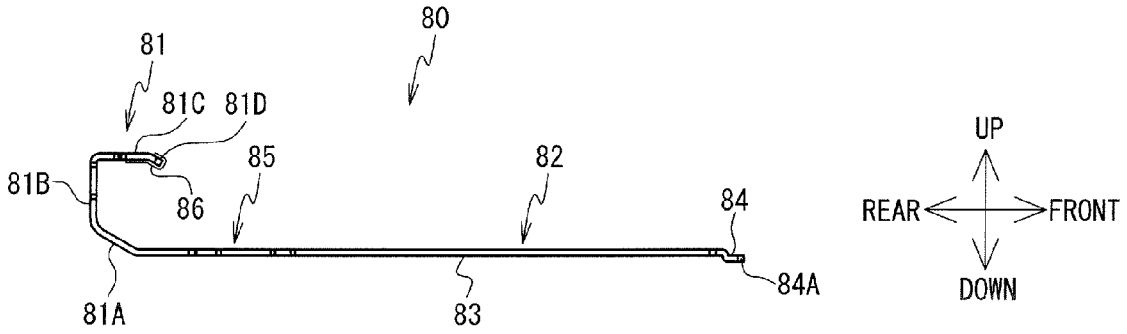
FIG. 9 is a left side view of the lock member.

The structure of the detection portion 82 will be explained with reference to FIGS. 8 to 10. The detection portion 82 includes the detection plate member 83 and a support point member 84. The detection plate member 83 is a plate that extends in the front-rear direction. The length of the detection portion 82 in the front-rear direction may be approximately one-third of the length of the first case 33 in the front-rear direction, for example. The support point member 84 projects toward the front from the center in the width direction of the front end of the detection plate member 83. The width of the support point member 84 is narrower than the width of the detection plate member 83. As shown in FIG. 9, the support point member 84 projects toward the front and downward from the detection plate member 83. A support point 84A is disposed in the center of the bottom side of the front end of the support point member 84. As shown in FIG. 8, the support point 84A is disposed on a center line C in the width direction of the detection plate member 83. The support point 84A is inserted into an insertion hole 84B provided in the first inner face 344. With the support point 84A serving as a support point, the lock member 80 rotates between the locked position (refer to FIG. 12A) and the released position (refer to FIGS. 12B and 12C). A hole 83A is provided in the rear end portion of the detection plate member 83 in order to reduce the weight of the lock member 80. The hole 83A may be either a through-hole or a recessed portion.

As shown in FIGS. 8 and 9, the connecting portion 85 is provided at the rear end of the detection plate member 83. The plate-shaped connecting portion 85 is Y-shaped in a plan view. A pair of inclined portions 81A, which will be described below, are plates connected to the rear ends of the connecting portion 85. The hook portion 81 includes the pair of the inclined portions 81A, a pair of vertical portions 81B, and an upper arm portion 81C. The inclined portions 81A are plate portions inclined upward toward the rear from the connecting portion 85. The inclined portions 81A connect the connecting portion 85 and the vertical portions 81B. As shown in FIGS. 8 to 10, the left-right pair of the vertical portions 81B are plate portions that extend upward from the rear ends of the corresponding inclined portions 81A. The pair of the vertical portions 81B are inclined in directions that bring their upper portions closer together such that the upper ends are connected. A hole 81G is provided between the pair of the inclined portions 81A in order to reduce the weight of the lock member 80.

The upper arm portion 81C extends toward the front from the portion where the upper ends of the vertical portions 81B are connected. The upper arm portion 81C may be parallel to the detection plate member 83, for example. A portion of the front end of the upper arm portion 81C is bent obliquely downward toward the front, toward the connecting portion 85. A tape 86 is affixed from the bottom face of the upper arm portion 81C, around a tip portion 81D, to the top face of the upper arm portion 81C. The outer face of the tape 86, that is, the opposite face of the tape 86 from the adhesive face, has less kinetic frictional resistance than the bottom face of the upper arm portion 81C. The same sort of the tape may be affixed to the outer surface of the roll-up member 43.

Figure 10:
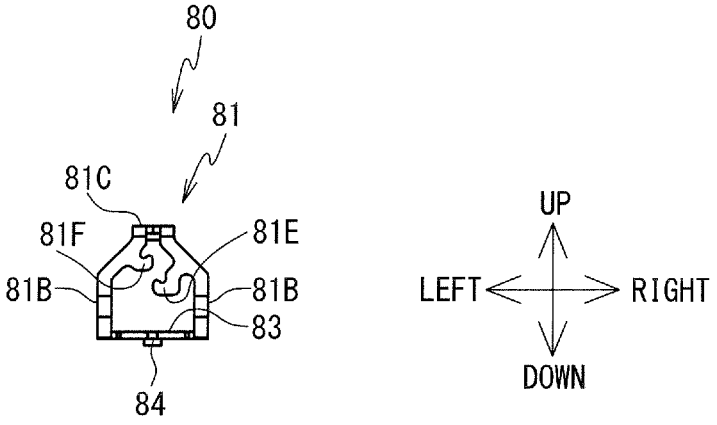
FIG. 10 is a rear view of the lock member.

As shown in FIG. 10, an anchoring portion 81E extends obliquely downward to the left from the upper portion of the vertical portion 81B on the right side, and an anchoring portion 81F extends obliquely downward to the right from the upper portion of the vertical portion 81B on the left side.

The position of the anchoring portion 81E is different from the position of the anchoring portion 81F in the up-down direction. For example, the anchoring portion 81E may be positioned lower than the anchoring portion 81F.

The coil spring 90 is an energizing member, such as a tension spring, for example, that extends in the up-down direction. The coil spring 90 is provided with a circular upper ring 90A on its upper end and a circular lower ring 90B on its lower end. The upper ring 90A is anchored to one of the anchoring portion 81E and the anchoring portion 81F. The lower ring 90B is anchored to the anchoring portion 400. The coil spring 90 energizes the hook portion 81 of the lock member 80 in the (downward) direction toward the first inner face 344 of the first case 33. As will be described in detail below, the energizing force of the elastic member 45 toward the front gives rise to a force that, through the roll-up member 43, causes the lock member 80 to move upward. When the force that causes the lock member 80 to move upward is greater than the total force (the downward force) of the load of the liquid container 31 and the energizing force of the coil spring 90, the roll-up member 43 moves toward the front.

When the upper ring 90A is anchored to the lower anchoring portion 81E, the length of the coil spring 90 is shorter than when the upper ring 90A is anchored to the upper anchoring portion 81F. When the upper ring 90A is anchored to the anchoring portion 81E, the energizing force with which the upper ring 90A energizes the hook portion 81 downward is weaker than when the upper ring 90A is anchored to the anchoring portion 81F. When the energizing force of the elastic member 45 is less than a specified value, for example, the upper ring 90A may be anchored to the lower anchoring portion 81E. In that case, the hook portion 81 moves upward and the roll-up member 43 moves toward the front, with the same sort of timing as when the energizing force of the elastic member 45 is within the specified value.

When the energizing force of the elastic member 45 is greater than the specified value, the upper ring 90A of the coil spring 90 may be anchored to the upper anchoring portion 81F. When the upper ring 90A is anchored to the upper anchoring portion 81F, the coil spring 90 extends farther, and the energizing force that energizes the hook portion 81 downward increases. Even when the energizing force of the elastic member 45 is greater than the specified value, the hook portion 81 moves upward, and the roll-up member 43 moves toward the front with the same sort of timing as when the energizing force of the elastic member 45 is within the specified value.

An operator may mount the cartridge case 3 in the cartridge mount portion 8 by pushing the front end of the cartridge case 3 into the opening 120 (refer to FIG. 1). At this time, the hollow needle (not shown in the drawings) pierces the rubber plug (not shown in the drawings) disposed in the spout 7 of the liquid container 31 accommodated in the cartridge case 3.

Figure 11:
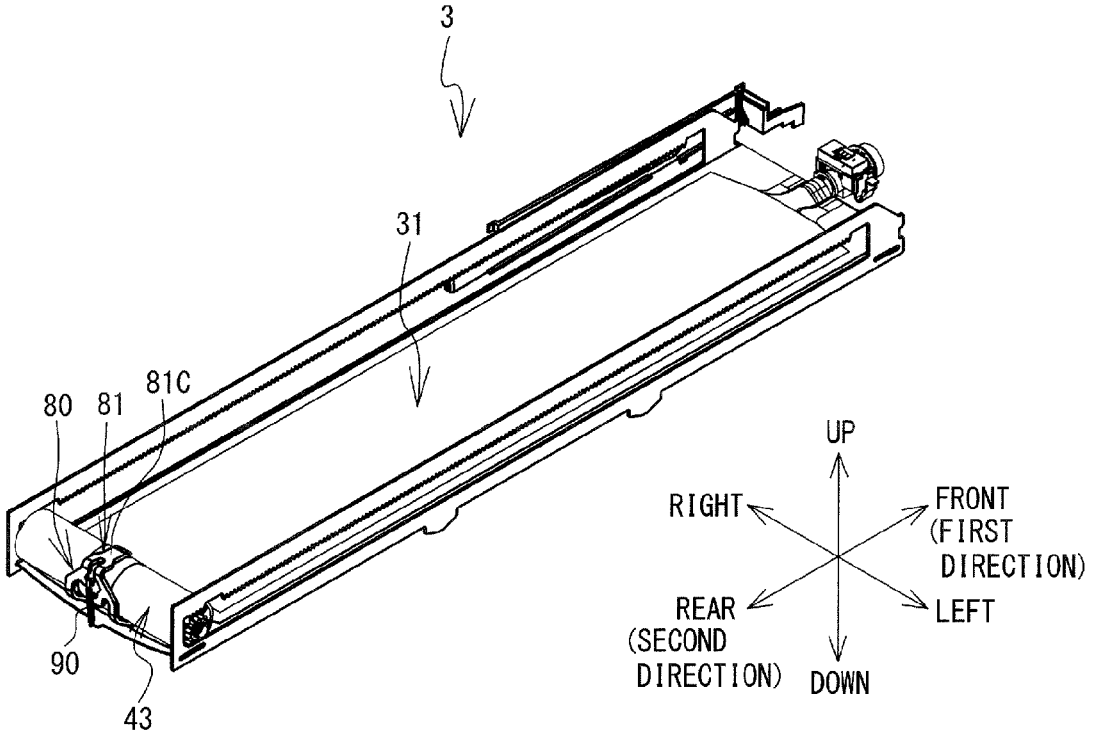
FIG. 11 is an oblique view of the cartridge case without a first case and the second case in a first state in which an ink inside the liquid container has not yet been consumed.
Figure 12A:
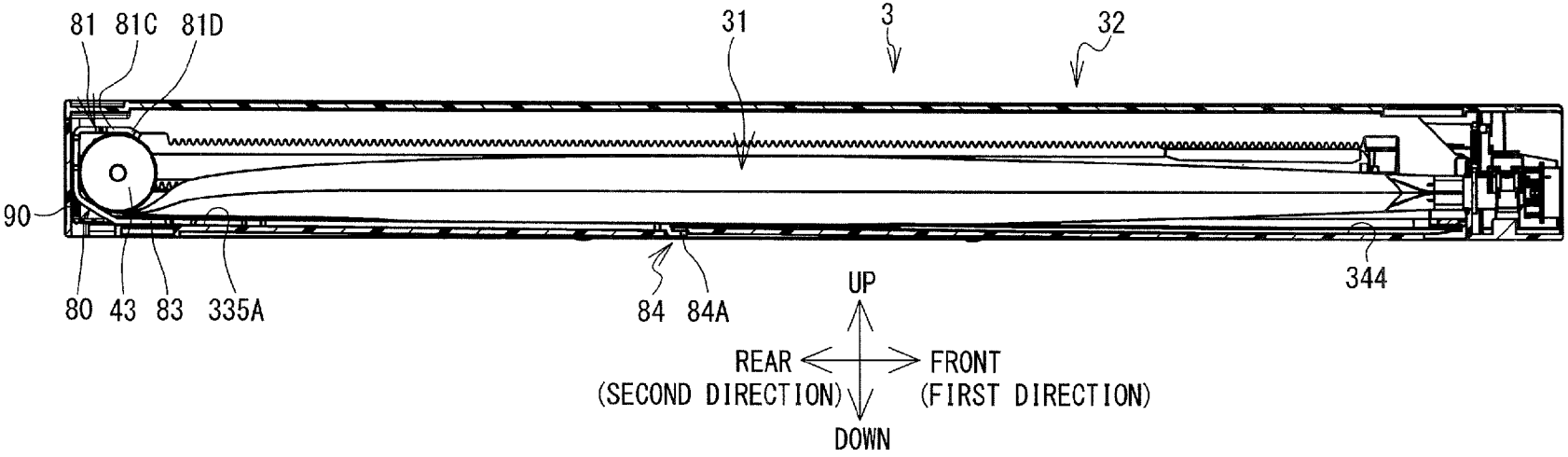
FIG. 12A is a section view of the cartridge case in a state in which the lock member has rotated to a locked position, as seen from the direction of arrows along a line X2-X2 in FIG. 2.

The operation of the lock member 80 will be explained with reference to FIGS. 11 to 13. As shown in FIGS. 11 and 12A, in a state (hereinafter called the first state) in which the ink inside the liquid container 31 has not yet been consumed, the roll-up member 43 is positioned toward the rear inside the case 32 of the cartridge case 3. Specifically, the roll-up member 43 is positioned in the rear end inside the case 32. The rear end inside the case 32 includes a position slightly toward the front from the rear end inside the case 32. When the roll-up member 43 is positioned in the rear end inside the case 32, the roll-up member 43 may have not rolled up the liquid container 31 at all, and the roll-up member 43 may have rolled up only the extension portion 134 provided at the second edge 132 of the liquid container 31. In the first state, the coil spring 90 energizes the lock member 80 downward. Due to the weight of the liquid container 31, a downward load bears on the detection plate member 83 of the lock member 80. A portion of the front end of the upper arm portion 81C is bent obliquely downward toward the front, toward the connecting portion 85. Therefore, the energizing force of the elastic member 45 toward the front gives rise to a force that, through the roll-up member 43, causes the lock member 80 to move upward. When the ink inside the liquid container 31 has not yet been consumed, the total force of the downward energizing force of the coil spring 90 and the downward load applied to the detection plate member 83 from the liquid container 31 is greater than the force that causes the lock member 80 to move upward. Therefore, the detection plate member 83 is positioned inside the groove portion 335A (refer to FIG. 5) on the first inner face 344 side of the detection plate member 83. As shown in FIGS. 11 and 12A, the upper arm portion 81C of the hook portion 81 of the lock member 80 holds the roll-up member 43 by engaging the roll-up member 43 from above toward the first inner face 344. Therefore, the moving of the roll-up member 43 toward the front by the energizing force of the elastic member 45 toward the front is locked by the hook portion 81. The position of the lock member 80 at this time is called the locked position.

Figure 12B:
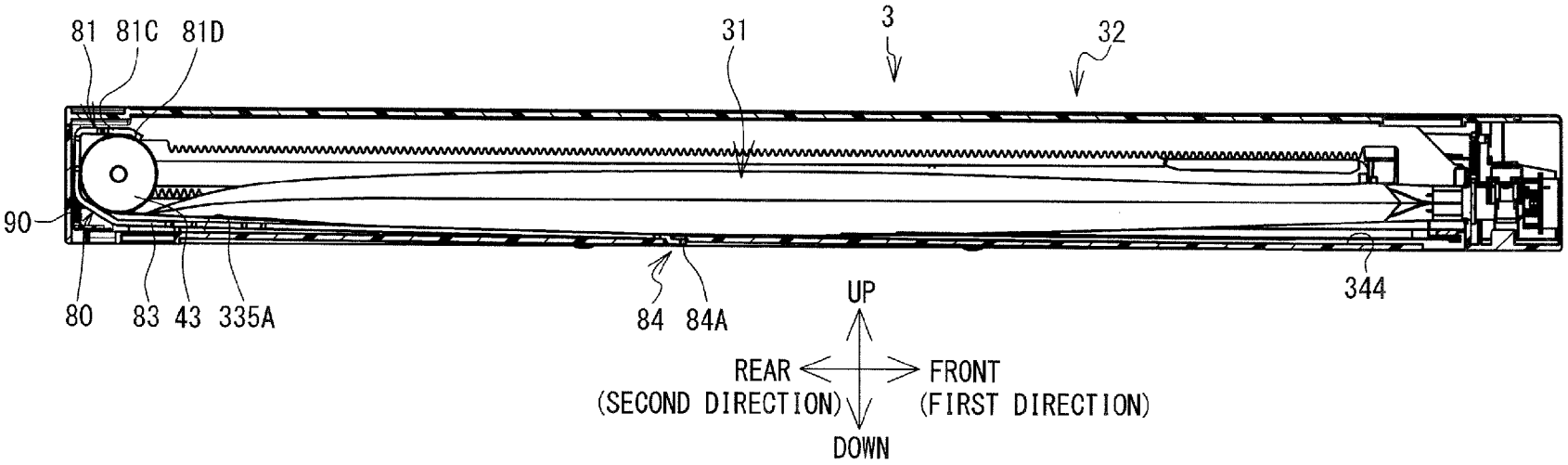
FIG. 12B is a section view of the cartridge case in a state in which the lock member has rotated to a released position, as seen from the direction of the arrows along the line X2-X2 in FIG. 2.
Figure 12C:
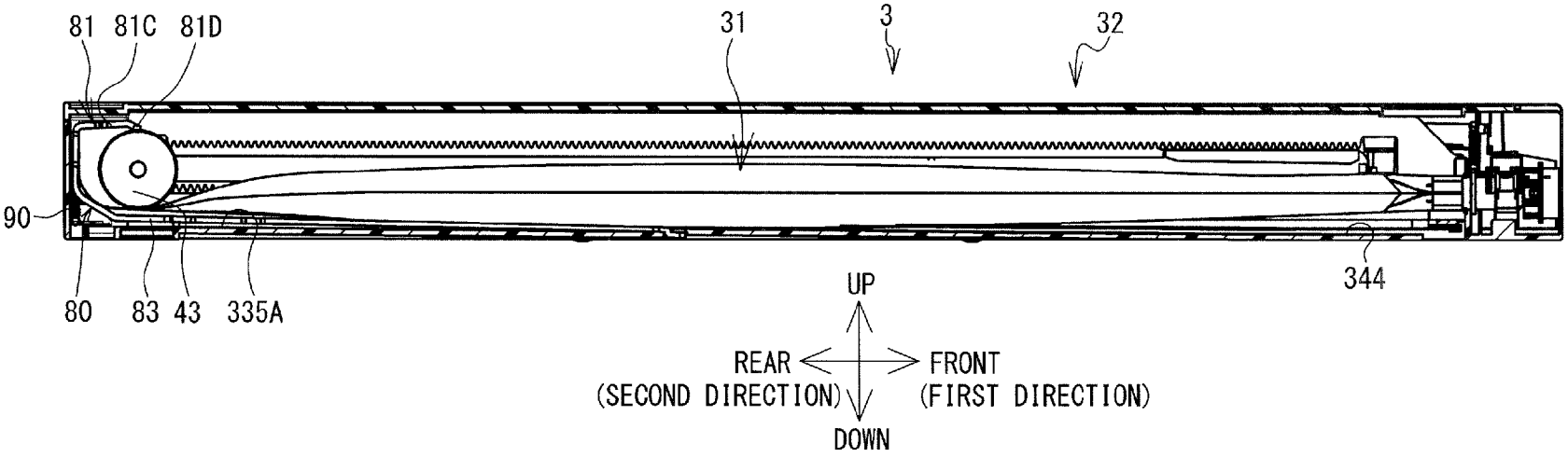
FIG. 12C is a section view of the cartridge case that shows a state in which a roll-up member is separated from a hook portion of the lock member, as seen from the direction of the arrows along the line X2-X2 in FIG. 2.

When the printer 1 performs a printing operation, the hollow needle draws the ink from inside the liquid container 31 to the outside of the liquid container 31, and the nozzles of the printer 1 eject the ink. As shown in FIGS. 12B and 12C, the amount of the ink inside the liquid container 31 decreases as the ink is drawn out, and the weight of the liquid container 31 decreases. Therefore, the load that bears on the detection plate member 83 of the lock member 80 is less than in the first state. The force with which the roll-up member 43, driven by the energizing force of the elastic member 45, causes the lock member 80 to move upward becomes greater than the total force of the downward energizing force of the coil spring 90 and the downward load that bears on the detection plate member 83 from the liquid container 31. Therefore, as shown in FIG. 12B, the lock member 80 rotates clockwise in a left side view, with the front end of the bottom face of the support point member 84 of the detection plate member 83 serving as the support point 84A. The part of the detection plate member 83 that is toward the hook portion 81 separates from the groove portion 335A (refer to FIG. 5) on the first inner face 344 side by moving upward from the groove portion 335A. Therefore, the upper arm portion 81C moves upward. The position of the lock member 80 at this time is called the released position. When the lock member 80 is positioned in the released position (refer to FIG. 12B), the hook portion 81 of the lock member 80 is positioned higher than when the lock member 80 is positioned in the locked position (refer to FIG. 12A).

Figure 13:
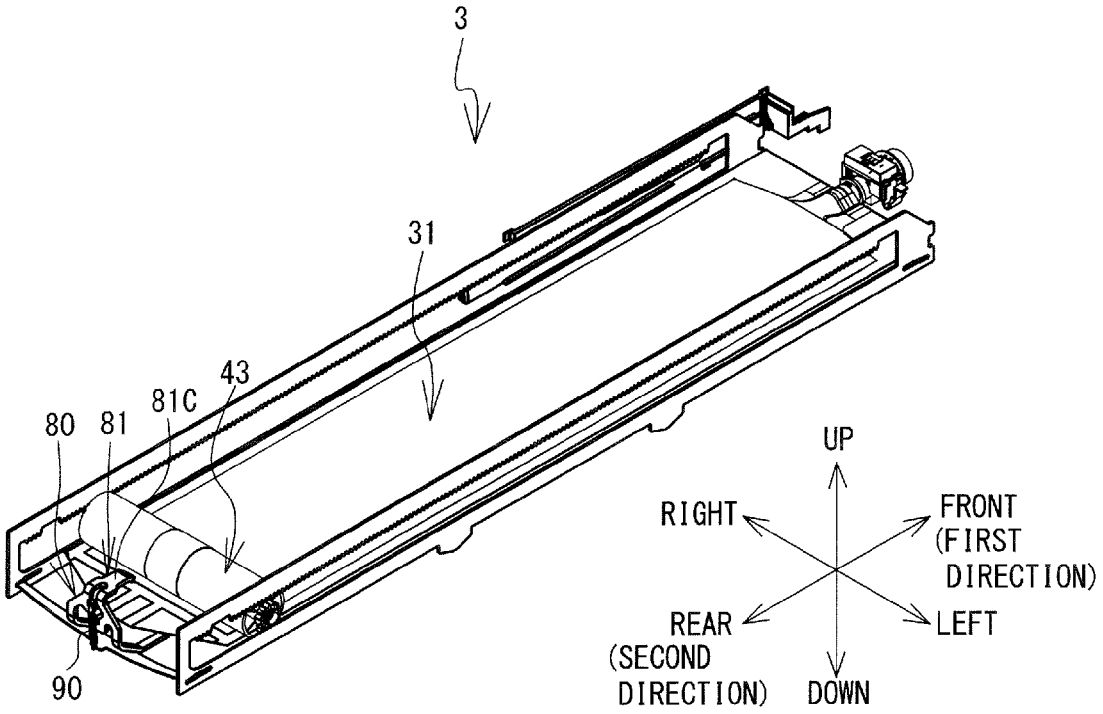
FIG. 13 is an oblique view of the cartridge case without the first case and the second case, showing the state in which the roll-up member is separated from the hook portion of the lock member.

As shown in FIG. 13, because the elastic member 45 applies an energizing force toward the front to the roll-up member 43, the roll-up member 43 separates from the upper arm portion 81C and moves toward the front. The outer face of the tape 86 affixed to the bottom face of the upper arm portion 81C has less kinetic frictional resistance than the bottom face of the base material that forms the upper arm portion 81C. Therefore, the roll-up member 43 separates smoothly from the upper arm portion 81C and rolls up the liquid container 31 by moving toward the front. Thereafter, the roll-up member 43 rolls up the liquid container 31 by moving toward the front as ink is ejected from the nozzles of the printer 1 and the ink flows out of the liquid container 31.

The relationship among the amount of ink inside the liquid container 31, the pressure of the ink, and the operation by which the roll-up member 43 rolls up the liquid container 31 in the present embodiment will be explained with reference to the graph shown in FIG. 14. In the graph, the amount of the ink inside the liquid container 31 when the ink has not yet been consumed is VFULL. In a state in which the central portion of the liquid container 31 bulges outward, dimples 135 (refer to FIG. 4) may form in the outer edges of the liquid container 31 toward the rear end. As the consumption of the ink inside the liquid container 31 progresses, the amount of the ink becomes V2. As the consumption of the ink inside the liquid container 31 progresses further, the amount of the ink becomes V1. When all of the ink inside the liquid container 31 has been consumed, the amount of the ink becomes V0. The upper limit of the pressure of the ink inside the liquid container 31 for supplying appropriate amount of the ink to each of the head units 100 and 200 is PU. The lower limit of the pressure of the ink inside the liquid container 31 for supplying appropriate amount of the ink to each of the head units 100 and 200 is PL.

When the amount of the ink is VFULL, the bulging of the liquid container 31 in the up-down direction is at its maximum. At this time, because the ink is present at a position that is higher than the spout 7, pressure is generated by the hydraulic head differential. The pressure of the ink is generated by the force with which the liquid container 31 shrinks. Therefore, the pressure of the ink inside the liquid container 31 is the greatest pressure between PU and PL. When the consumption of the ink progresses and the amount of the ink becomes V2, the pressure of the ink inside the liquid container 31 decreases compared with when the amount of the ink was VFULL. When the amount of the ink is between VFULL and V2, the pressure of the ink inside the liquid container 31 is adequate. Therefore, it is not necessary for the liquid container 31 to be rolled up by the roll-up member 43. The dimples 135 may form in the outer edges of the liquid container 31 toward the rear end. It is therefore preferable for the hook portion 81 of the lock member 80 to lock the movement of the roll-up member 43 toward the front.

When the consumption of the ink progresses and the amount of the ink decreases from V2 toward V1, the pressure of the ink decreases toward PL. The dimples 135 in the outer edges of the liquid container 31 toward the rear end disappear as the ink is consumed between V2 and V1. Therefore, when the amount of the ink is between V2 and V1, the load of the liquid container 31 that bears on the detection plate member 83 decreases, and the lock member 80 rotates from the locked position to the released position. The roll-up member 43 separates from the hook portion 81 of the lock member 80 at a point R shown in FIG. 14, for example. At this time, as shown in FIG. 13, the rolling-up of the liquid container 31 by the roll-up member 43 begins. As shown in FIG. 14, when the amount of the ink is between V1 and V0, the roll-up member 43 raises the pressure of the ink by rolling up the liquid container 31. Therefore, when the amount of the ink is between VFULL and V0, the pressure of the ink is a value between the upper limit PU and the lower limit PL. Therefore, an appropriate amount of the ink flows to the head units 100 and 200, and the possibility that the printing quality may deteriorate is reduced.

In a state in which the ink inside the liquid container 31 has not yet been consumed and the central portion of the liquid container 31 bulges outward, the dimples 135 may form in the outer edges of the liquid container 31 toward the rear end. In this situation, when the roll-up member 43 rolls up the liquid container 31 from the rear end, there is a possibility that the dimples 135 may become even larger. In that case, there is a possibility that a rolling-up abnormality occur, such as the roll-up member 43 rolling up the liquid container 31 without flattening the liquid container 31. In this case, if the energizing force of the elastic member 45 is increased for the purpose of causing the roll-up member 43 to roll up and flatten the liquid container 31, for example, the pressure of the ink inside the liquid container 31 may become greater than an appropriate value. The possibility therefore arises that an appropriate amount of the ink may not flow to the head units 100 and 200, causing the printing quality to deteriorate.

Even when the ink inside the liquid container 31 has not yet been consumed and the dimples 135 have formed in the outer edges of the liquid container 31 toward the rear end (the second edge 132), the lock member 80 locks the movement of the roll-up member 43 from the rear toward the front.

Therefore, in a state in which the dimples 135 have formed, the lock member 80 can reduce the possibility that the roll-up member 43 may roll up the liquid container 31 from the rear. It is thus possible to reduce the possibility that a rolling-up abnormality may occur, such as the roll-up member 43 rolling up the liquid container 31 without flattening the liquid container 31. Because the pressure of the ink inside the liquid container 31 is an appropriate value, the possibility that the printing quality may deteriorate can be reduced.

In a state in which the dimples 135 have formed, in order for the roll-up member 43 to roll up the liquid container 31 without flattening the liquid container 31, it may be necessary to increase the energizing force of the elastic member 45. However, in the present embodiment, the need to increase the energizing force of the elastic member 45 is reduced by using the hook portion 81. It is thus possible to reduce the possibility that the pressure of the ink inside the liquid container 31 may become greater than an appropriate value and an appropriate amount of the ink may not flow to the head units 100 and 200. The possibility that the printing quality may deteriorate can therefore be reduced.

Figure 14:
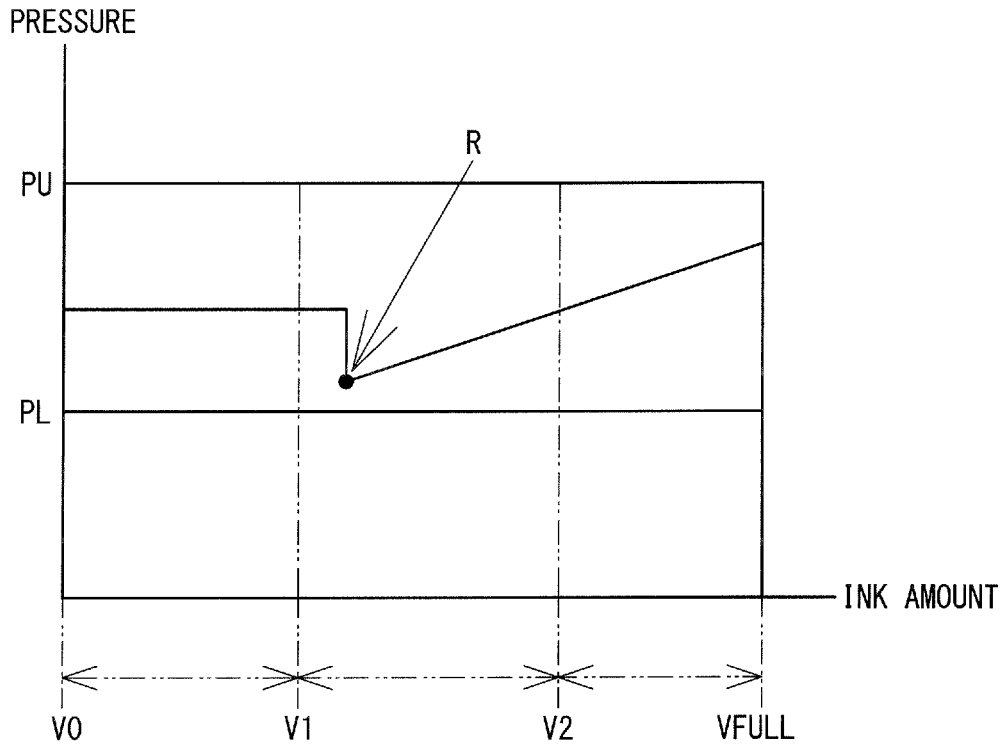
FIG. 14 is a graph that shows the amount and the pressure of the ink inside the liquid container.

As shown in the graph shown in FIG. 14, when the ink inside the liquid container 31 is consumed without the roll-up member 43 separating from the hook portion 81 of the lock member 80, the pressure of the ink inside the liquid container 31 decreases. As the ink is consumed, the load of the liquid container 31 that bears on the detection plate member 83 of the detection portion 82 decreases. When the detection portion 82 detects that a specified amount of the ink has been consumed, the lock member 80 releases its lock on the movement of the roll-up member 43 toward the front, so the roll-up member 43 can move toward the front. Therefore, as shown in FIG. 13, the roll-up member 43 rolls up the liquid container 31, so that a constant pressure is applied to the ink. When the specified amount of the ink has been consumed, the possibility that the printing quality may deteriorate can be reduced.

As shown in FIGS. 11 and 12A, the upper arm portion 81C of the hook portion 81 of the lock member 80 engages the roll-up member 43 on the opposite side from the first inner face 344 and holds the roll-up member 43. The hook portion 81 thus locks the movement of the roll-up member 43 toward the front that is due to the energizing force of the elastic member 45 toward the front. When the roll-up member 43 separates from the hook portion 81, the roll-up member 43 is in sliding contact with the upper arm portion 81C of the hook portion 81, and thus kinetic frictional resistance is generated. In contrast to this, when the roll-up member 43 separates from the hook portion 81 while the upper arm portion 81C is engaged with the roll-up member 43 from the lower side of the roll-up member 43, there is a possibility that the upper arm portion 81C and the roll-up member 43 may be in rolling contact. Therefore, the frictional resistance, which is less than the kinetic frictional resistance, is generated. Therefore, when the upper arm portion 81C engages and holds the roll-up member 43 from the upper side, the lock member 80 can hold the roll-up member 43 more securely than when the upper arm portion 81C engages and holds the roll-up member 43 from the lower side.

The detection portion 82 includes the detection plate member 83, which is disposed on the first inner face 344. The detection plate member 83 is disposed below the liquid container 31. A load bears on the detection plate member 83 from the liquid container 31. Therefore, the weight of the liquid container 31 is detected in accordance with the consumption of the ink inside the liquid container 31, so that it possible for the locking of the movement of the roll-up member 43 toward the front by the lock member 80 to be released with the optimum timing, in accordance with the change in the weight of the liquid container 31.

The detection portion 82 is not limited to the configuration in the present embodiment. For example, instead of using the detection portion 82 of the present embodiment, an electrical sensor element may be used to detect the weight of the liquid container 31 or a detection plate member may be disposed on a position other than the first inner face 344. However, because the detection portion 82 of the present embodiment uses the detection plate member 83 disposed on the first inner face 344 to detect the weight of the liquid container 31, the detection portion 82 can be implemented in a simple configuration.

The coil spring 90 energizes the detection plate member 83 toward the first inner face 344. The timing at which the lock is released at the point R shown in FIG. 14 is adjusted by adjusting the energizing force of the coil spring 90. Therefore, the operator can adjust the timing at which the roll-up member 43 starts to roll up the liquid container 31. The cartridge case 3 may be turned upside-down, for example, in order to churn the ink inside the liquid container 31. In this case, the coil spring 90 energizes the detection plate member 83 toward the first inner face 344. It is therefore possible to prevent the lock member 80 from moving of its own weight toward the second case 60 and the roll-up member 43 from moving freely. Because the coil spring 90 energizes the detection plate member 83 toward the first inner face 344, the detection plate member 83 can be prevented from engaging with the second inner face 644 of the second case 60.

The lock member 80 can rotate in the upward direction and the downward direction around the support point 84A. The upward direction is the direction in which the detection plate member 83 moves away from the first inner face 344. The cartridge case 3 can rotate the lock member 80 to the locked position and the released position in accordance with the change in the load based on the consumption of the ink. Therefore, the roll-up member 43 can start to roll up the liquid container 31 when the dimples 135 have disappeared by the consumption of the ink.

Because the support point 84A is disposed in the center of the first inner face 344 in the left-right direction, the detection plate member 83 can be disposed in the center of the first inner face 344. It is therefore easy for the detection plate member 83 to detect the weight of the liquid container 31 accurately. The support point 84A is disposed on the center line C of the detection plate member 83. Therefore, the detection plate member 83 resists twisting in the left-right direction, and thus its range of rotation can be enlarged. Therefore, the detection plate member 83 can detect the weight of the liquid container 31 even more accurately.

The case recessed portion 335 and the groove portion 335A are provided in the first inner face 344. The case recessed portion 335 accommodates the elastic member 45. The groove portion 335A of the case recessed portion 335 accommodates the detection plate member 83. The detection plate member 83 is disposed under the elastic member 45. Therefore, when the roll-up member 43 moves toward the front while rolling up the elastic member 45, the detection plate member 83 does not interfere with the operation of the roll-up member 43 and the elastic member 45.

The anchoring portion 81E and the anchoring portion 81F anchor the upper end of the coil spring 90, which is an energizing member. The anchoring portion 81E and the anchoring portion 81F are positioned in different positions in the up-down direction of the lock member 80. Therefore, the energizing force of the coil spring 90 can be changed by changing the position where the upper end of the coil spring 90 is anchored. For example, variations in the energizing force of the elastic member 45 may occur during the manufacturing process. When the energizing force of the elastic member 45 is greater than a specified value, the upper end of the coil spring 90 is anchored to the anchoring portion 81F. When the energizing force of the elastic member 45 is less than the specified value, the energizing force of the elastic member 45 toward the front is weaker, making it more difficult for the roll-up member 43 to separate from the hook portion 81 of the lock member 80. When the upper end of the coil spring 90 is anchored to the anchoring portion 81E, the energizing force that pulls the hook portion 81 downward is less than when the upper ring 90A of the coil spring 90 is anchored to the anchoring portion 81F. Therefore, the roll-up member 43 can separate from the hook portion 81 at the same timing as when the energizing force of the elastic member 45 is within the specified value.

When the energizing force of the elastic member 45 is greater than the specified value, the energizing force of the elastic member 45 toward the front is stronger. The roll-up member 43 separates from the hook portion 81 of the lock member 80 more easily. When the upper ring 90A of the coil spring 90 is anchored to the anchoring portion 81F, the energizing force that pulls the hook portion 81 downward becomes greater than when the upper end of the coil spring 90 is anchored to the anchoring portion 81E. Therefore, the roll-up member 43 can separate from the hook portion 81 at the same timing as when the energizing force of the elastic member 45 is within the specified value. Even when the liquid bags 13 have different rigidities, and even when the inks have different viscosities, the energizing force of the coil spring 90 can be modified by changing the position to which the upper ring 90A of the coil spring 90 is anchored.

The tape 86 is affixed to the bottom face of the hook portion 81. The bottom face of the hook portion 81 is opposed to the roll-up member 43. The kinetic frictional resistance of the outer face of the tape 86 is less than that of the bottom face of the hook portion 81. The roll-up member 43 can therefore separate smoothly from the upper arm portion 81C.

The hole 83A and the hole 81G are provided in the lock member 80 to reduce its weight. Reducing the weight of the lock member 80 makes it possible to further reduce the force of the coil spring 90, which is an energizing member. Therefore, of the forces that lock the movement of the roll-up member 43 (the weight of the liquid container 31 and the force of the coil spring 90), the ratio of the weight of the liquid container 31 becomes greater. That improves the sensitivity of the detection portion 82 in detecting the consumed amount of the ink inside the liquid container 31. The forming of the hole 83A and the hole 81G in the lock member 80 can ensure space for placing the lock member 80 and can make it possible to reduce the weight of the lock member 80.

Figure 15:
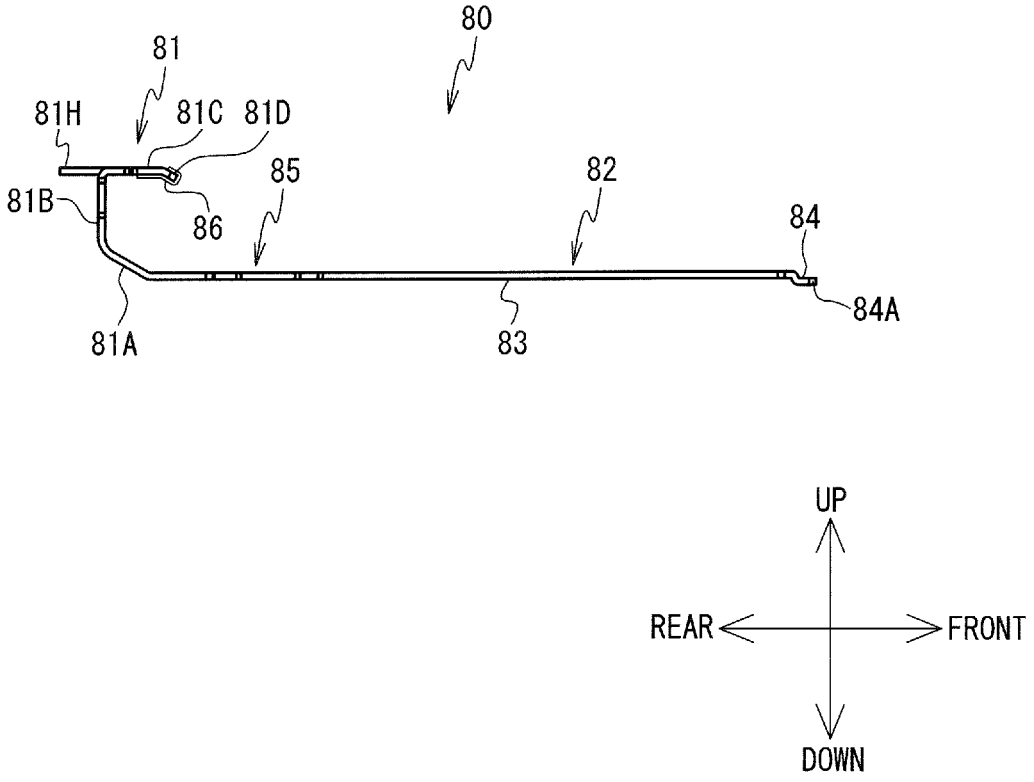
FIG. 15 is a left side view of a modified example of the lock member.

Various modifications can be made to the above embodiment. As shown in FIG. 15, a lever-shaped operation portion 81H may extend toward the rear from the upper arm portion 81C of the hook portion 81 of the lock member 80. The operation portion 81H may project outward from an opening provided in the rear wall portion 334 of the first case 33. In this case, the operator can rotate the lock member 80 manually from the locked position to the released position by manually lifting the operation portion 81H. The operator can therefore release the lock of the lock member 80 as desired. It is acceptable for the second case 60 not to be provided and for the top side of the cartridge case 3 to be open.

The coil spring 90 may energize the lock member 80 in a direction that moves the hook portion 81 upward from the first inner face 344 of the first case 33. When the upper ring 90A of the coil spring 90 is anchored to the anchoring portion 81E, the length of the coil spring 90 becomes shorter than when the upper ring 90A is anchored to the anchoring portion 81F. Therefore, the compression of the coil spring 90 becomes stronger, and the energizing force that lifts the hook portion 81 upward becomes stronger. At this time, the roll-up member 43 easily separates from the hook portion 81 of the lock member 80. Therefore, when the energizing force of the elastic member 45 is less than the specified value, for example, the upper ring 90A may be anchored to the anchoring portion 81E. When the energizing force of the elastic member 45 is greater than the specified value, for example, the upper ring 90A may be anchored to the anchoring portion 81F.

The cartridge case 3 may be provided with a sensor. The locking by the lock member 80 may then be released in accordance with the ink consumption that corresponds to the detecting, by the sensor, of the height of the liquid container 31.

The lock member 80 does not necessarily have to engage with the roll-up member 43 from above. For example, the lock member 80 may engage with the roll-up member 43 from the left, from the right, and from below. The hook portion 81 of the lock member 80 may engage with the shaft support portions 431 and 432 of the roll-up member 43. The hook portion 81 and the detection portion 82 of the lock member 80 may be provided as separate units, and the cartridge case 3 may be provided with a linking mechanism, for example. The linking mechanism may have a configuration in which the hook portion 81 operates in coordination with the detection result of the detection portion 82.

It is acceptable for the hole 83A and the hole 81G not to be provided. The number of the anchoring portions to which the upper ring 90A of the coil spring 90 is anchored is not limited to two, and may be any number, such as one or three, for example. In the above embodiment, the energizing force of the coil spring 90 varies according to the difference in the positions of the anchoring portion 81E and the anchoring portion 81F in the up-down direction. However, the energizing force of the coil spring 90 may be varied by a configuration in which the height of a single anchoring portion can be varied. For example, the height of a single anchoring portion may be varied by adjusting a screw.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A cartridge case comprising:

a case including a first face extending in a first direction;

a spout support portion provided on an end portion side of the case, the end portion side being a side on which an end portion of the case is provided in the first direction, and the spout support portion being configured to support a spout provided on a liquid container containing an inkjet liquid;

a mount portion in which an end portion on a first direction side of an elastic member is mountable, the mount portion being provided on the end portion side of the case, the elastic member extending in a second direction, the second direction being an opposite direction from the first direction, and the elastic member generating an energizing force in the first direction;

a roll-up member including a shaft, the shaft extending in an orthogonal direction, the orthogonal direction being a direction parallel to the first face and orthogonal to the first direction, and the shaft configured to roll up the liquid container with a circumference of the shaft by being moved in the first direction by the energizing force of the elastic member; and a lock member including an engagement portion, the engagement portion configured to lock movement, in the first direction, of the shaft by engagement with the shaft when the shaft is positioned at an end of the case in the second direction, the engagement portion being configured to release the engagement with the shaft based on consumption of the inkjet liquid contained in the liquid container when the shaft positioned at the end of the case in the second direction.

2. The cartridge case according to claim 1, further comprising:

a detection portion configured to detect a remaining amount of the inkjet liquid contained in the liquid container, wherein the lock member is configured to, when the detection portion detects consumption of a specified amount of the inkjet liquid, release the lock of the roll-up member and allow the roll-up member to move in the first direction.

3. The cartridge case according to claim 2, wherein the lock member includes a hook portion, the hook portion configured to engage with the shaft and prevent the shaft from moving in the first direction.

4. The cartridge case according to claim 3, wherein the hook portion is configured to engage with the shaft from an opposite side of the shaft from the first face.

5. The cartridge case according to claim 2, wherein the detection portion includes a detection plate member disposed on the first face.

6. The cartridge case according to claim 5, further comprising:

an energizing member energizing the detection plate member toward the first face.

7. The cartridge case according to claim 5, wherein the lock member includes a support point, the detection plate member is configured to rotate around the support point in a separating direction and in an opposite direction from the separating direction, the separating direction being a direction in which the detection plate member is separated from the first face, the lock member is configured to, when the detection plate member rotates in the opposite direction, rotate to a locked position, the locked position being a position in which the lock member prevents the roll-up member from moving in the first direction, and the lock member is configured to, when the detection plate member rotates in the separating direction, rotate to a released position, the released position being a position in which the lock member allows the roll-up member to move in the first direction.

8. The cartridge case according to claim 7, wherein the support point is disposed on the first face.

9. The cartridge case according to claim 8, wherein the support point is disposed in a center of the first face in the orthogonal direction.

10. The cartridge case according to claim 5, wherein a groove portion is provided in the first face, the groove portion accommodating the detection plate member and the elastic member, and the detection plate member is disposed under the elastic member.

11. The cartridge case according to claim 6, wherein the lock member includes a plurality of anchoring portions each configured to anchor the energizing member, and the plurality of the anchoring portions are provided in different positions in a direction in which the energizing member energizes the detection plate member.

12. The cartridge case according to claim 3, wherein a friction reduction member is disposed on an opposing face of the hook portion, the opposing face being opposed to the roll-up member, and the friction reduction member having a less kinetic friction coefficient than that of the opposing face.

13. The cartridge case according to claim 1, wherein the lock member includes a hole.

14. The cartridge case according to claim 7, further comprising:

an operation portion configured to operate, from outside the case, moving of the lock member from the locked position to the released position.

* * * * *